US006327861B2

(12) United States Patent
Sato et al.

(10) Patent No.: US 6,327,861 B2
(45) Date of Patent: Dec. 11, 2001

(54) GAS TURBINE COMBUSTOR

(75) Inventors: Yoshichika Sato; Yoji Kochi; Koichi Akagi; Kazuya Kobayashi; Koichi Nishida; Shinji Akamatsu; Hideki Haruta; Kotaro Miyauchi; Rintaro Chikami; Shigemi Mandai; Masataka Ota, all of Takasago (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/862,468

(22) Filed: May 23, 2001

Related U.S. Application Data

(62) Division of application No. 09/437,146, filed on Nov. 10, 1999.

(30) Foreign Application Priority Data

Nov. 12, 1998 (JP) ..... 10-322630
Dec. 8, 1998 (JP) ..... 10-348838

(51) Int. Cl.[7] ..... F02C 1/00
(52) U.S. Cl. ..... 60/746
(58) Field of Search ..... 60/746, 747

(56) References Cited

U.S. PATENT DOCUMENTS 4,704,869 11/1987 Iizuka et al. .
4,852,355 8/1989 Kenworthy .
4,872,312 10/1989 Iizuka .
5,220,795 * 6/1993 Dodds ..... 60/747
6,026,645 * 2/2000 Stokes ..... 60/737
6,038,861 * 3/2000 Amos ..... 60/737
6,047,551 * 4/2000 Ishiguro ..... 60/740
6,082,111 * 7/2000 Stokes ..... 60/737

FOREIGN PATENT DOCUMENTS 6-257750 9/1994 (JP) .
9-21531 1/1997 (JP) .

* cited by examiner

*Primary Examiner*—Charles G. Freay
*Assistant Examiner*—Ehud Gartenberg
(74) *Attorney, Agent, or Firm*—Wenderoth, Lind & Ponack, L.L.P.

(57) ABSTRACT

In a central portion of inner tube 28 of combustor 20, pilot fuel nozzle 22 and pilot cone 33 are arranged and main fuel nozzles 21 and main swirlers 32 therearound. Air intake portion (X-1) is provided with rectifier tube 11 for making air intake uniform. In air intake portion (X-2), air holes of appropriate number of pieces are provided in circumferential wall of the inner tube 28. In main swirler portion (X-3) and pilot cone portion (X-4), bolt joint of the main swirlers 32 is employed and optimized welded structure having less influence of thermal stress of the pilot swirler 33 is employed, respectively. Tail tube cooling portion (X-5) is provided with cooling structure having less influence of thermal stress to cool flange 71 portion of tail tube 24 uniformly. By the improvements in the portions (X-1) to (X-5), obstacles in attaining higher temperature in the combustor 20 is dissolved and combustor performance is enhanced.

10 Claims, 25 Drawing Sheets

Fig. 27 (a) (Prior Art)

Fig. 27 (b) (Prior Art)

GAS TURBINE COMBUSTOR

This is a Divisional Application of U.S. patent application Ser. No. 09/437,146, filed Nov. 10, 1999.

BACKGROUND OF THE INVENTION

1. Field of the Invention

The present invention relates generally to a combustor of a gas turbine, and more particularly to a combustor structured such that uniformity of combustion air intake is attained so as to enhance combustion efficiency and combustor cooling ability, as well as a fitting structure of structural portions which are less durable against thermal stress, such as a combustor main swirler or a pilot cone. They are improved so as to not be influenced by high temperature, whereby overall efficiency of the gas turbine combustor is enhanced in view of recent tendencies of higher temperature combustion gas. The present invention also relates to a combustor of a gas turbine having reduced combustion vibration.

2. Description of the Prior Art

FIG. 20 shows a structural arrangement of a representative gas turbine combustor and surrounding portions thereof in the prior art. In FIG. 20, numeral 20 designates a combustor, which is provided in a turbine casing 50. Numeral 21 designates main fuel nozzles provided in plural pieces in a circumferential direction the combustor and is to be supplied with a main fuel of oil or gas. Numeral 22 designates a pilot fuel nozzle, which is provided in a central portion of the plural main fuel nozzles 21 for igniting the main fuel nozzles 21. Numeral 23 designates a combustion chamber, and numeral 24 designates a tail tube, from which a high temperature gas produced in the combustion chamber 23 is led into a gas turbine. Numeral 62 designates a compressor, numeral 63 designates an air outlet, numeral 64 designates an air separator for supplying gas turbine blades with outside air for cooling thereof, numeral 65 designates a gas turbine stationary blade and numeral 66 designates a gas turbine moving blade.

In the combustor constructed as mentioned above, air 40 coming from the compressor 62 flows into the turbine casing 50 via the air inlet 63 and further flows into the combustor 20, for effecting combustion, from around the combustor 20 through spaces formed between stays, described later, as air shown by numerals 40*a*, 40*b*. In the flow of the air 40 at this time, there arises differences in the flow rate and pressure between the air 40*a* which is near the air outlet 63 or the compressor 62 and the air 40*b* which is far from the air outlet 63 or the compressor 62. This causes a non-uniformity in the air flow entering the combustor 20 according to the circumferential directional position thereof, with the result that a biased flow of air arises in an inner tube, described later, in the combustor 20, causing a non-uniformity of fuel flow as well, which leads to an increase of $NO_x$ formation.

FIG. 21 is an enlarged schematic view of the gas turbine combustor of FIG. 20. In FIG. 21, there are shown several structural portions having shortcomings to be addressed. That is, an (X-1) portion and an (X-2) portion are air intake portions into the fuel nozzles, an (X-3) portion is a main swirler fitting structural portion, an (X-4) portion is a pilot cone fitting structural portion and an (X-5) portion is a tail tube cooling structural portion. There are problems to be solved in the respective portions. Such problems as exist in the present situation will be sequentially described below.

The air intake portion (X-1) will be described first. FIG. 22 is a cross sectional view of a top hat type fuel nozzle portion of a prior art gas turbine. In FIG. 22, the air 40*a*, 40*b* coming from the compressor flows into the combustor 20 for effecting a combustion from around the combustor 20 through spaces formed between supports 25 provided in the combustor 20. Between the air 40*a* which is near the compressor and the air 40*b* which is far from the compressor, there are differences in the flow passages themselves and the shapes thereof, which causes a non-uniformity in the flow rate of the air flowing into the combustion chamber 23 according to the circumferential directional position thereof so as to cause a biased flow of the air. By this biased flow of the air, fuel flow also becomes non-uniform in the combustion chamber, and $NO_x$ formation increases. It is needed, therefore, that the air flow into the combustor be uniform in the circumferential direction.

Also, in the combustor of FIG. 22 which is of the top hat type, there is fitted to the turbine cylinder 50 an outer tube casing cover 51 for covering a portion where the fuel nozzles are inserted. On the other hand, in the combustor of FIG. 20, the air intake portion is arranged in a space formed by a cylindrical casing of the turbine casing 50. In the example of FIG. 22, a portion surrounding the supports 25 as the air intake portion is covered by the cylindrical outer tube casing cover 51. The outer tube casing cover 51 is of a hat-like shape which projects toward the outside. In this type of combustor, a central axis 61 of the outer tube casing cover 51 of the turbine casing 50 and a central axis 60 of the combustor do not coincide with each other, and the combustor is fitted to the outer tube casing cover 51 so as to incline slightly thereto. Although a detailed explanation of the reason therefor is omitted, while the combustion gas flowing through the inner tube and the tail tube is led into a gas turbine combustion gas path, the temperature distribution of the gas flow is needed to be made as uniform as possible. In order to realize an optimized temperature distribution according to the manner in which the combustor is fitted, the central axis 60 of the combustor is inclined slightly relative to axis 61 of the outer tube casing cover 51.

In the portion surrounding the supports 25, as the air intake portion in such combustor, there are differences along the circumferential direction in the space areas formed by the outer tube casing cover 51 and the supports 25, and while the quantity of intake air is varied in this way, there is still a non-uniformity of the intake air. In this type of combustor, while the outer tube casing cover 51 functions as a correcting tube to some extent, so that there is obtained some correction effect of the air flow coming into the combustor, as compared with the combustor of FIG. 20, the air takes turns at the air intake portion surrounding the supports 25 to flow into the nozzle portion. This causes a non-uniformity of the air flow, and hence improvement so as to realize a more uniform flow of the air is desired.

Next, a problem existing in the air intake portion (X-2) will be described. FIG. 23 is a side view of an inner tube portion of the combustor 20 of FIG. 20. In FIG. 23, a high temperature combustion gas 161 flows through the inside of an inner tube 28. In a circumferential surface of the inner tube 28, which is exposed to the high temperature gas, there are provided a multiplicity of small cooling holes (not shown). Air flowing through these cooling holes cools the inner tube 28 to then flow out to be mixed into the combustion gas flowing inside the inner tube 28. On the other hand, there remains an unburnt component of fuel in the combustion gas flowing through the inner tube 28, increasing the $NO_x$ formation, and hence it is necessary to sufficiently burn the unburnt component. For this purpose, there are provided in the circumferential surface of the inner tube 28, air holes 10-1, 10-2, and 10-3 formed in three rows, with six air holes in each of the rows. The six air holes of each row are arranged with equal intervals between them in the circumferential direction of the inner tube 28, as shown in FIG. 23.

In the inner tube 28 constructed as above, the combustion gas 161 produced by the main fuel nozzle 21 flows through the inner tube 28 to flow to the tail tube 24. For combustion of the unburnt component of fuel contained in the high temperature combustion gas 161, air 130 is led into the inner tube 28 through the first row of air holes 10-1 and the second row of air holes 10-2. Further, air 131 is led into the inner tube 28 through the downstream third row of air holes 10-3 for combustion of the unburnt component still remaining unburnt.

The air entering the combustor 20 comprises three portions, that is, the air used for combustion at the nozzle portion of the combustor, the air entering the inner tube 28 for cooling thereof through the small cooling holes and the air 130, 131 flowing into the inner tube 28 through the air holes 10-1, 10-2, and 10-3. Where the total quantity of these three portions of the air is 100%, as one example in a prior art combustor, the quantity of the air flowing through the air holes 10-1, and 10-2 is about 14% each, and that of the air flowing through the air holes 10-3 is about 19 to 20%. If the respective quantities are expressed in a ratio for the air holes 10-1, 10-2 and 10-3, it is expressed as approximately 1:1:(1.3 to 1.4). That is, the air quantity entering the inner tube 28 through the downstream air holes 10-3 is largest. But if the air quantity entering through the air holes 10-3 becomes excessive, it remains unused for combustion, and cools flames of the high temperature combustion gas to thereby cause a colored smoke.

Next, a problem existing in the main swirler portion (X-3) will be described. In a prior art multiple type premixture combustor of a gas turbine, a pilot swirler is provided in a center thereof and eight pieces of main swirlers are arranged therearound. Each of the main swirlers is fixed by welding to an inner wall of the combustor via a thin fixing member of about 1.6 mm thickness. FIG. 24 is a cross sectional side view showing a swirler portion and a pilot cone portion of the type of combustor in the prior art and FIG. 25 is a partial view seen from plane H—H of FIG. 24. In FIGS. 24 and 25, numeral 20 designates a combustor, numeral 31 designates a pilot swirler provided in a center of the combustor 20 and numeral 33 designates a pilot cone fitted to an end of the pilot swirler 31. Numeral 32 designates a main swirler, which is arranged in eight pieces around the pilot swirler 31. Numeral 34 designates a base plate which is formed in a circular shape and has its circumferential portion fixed by welding to the inner wall of the combustor 20. In the base plate 34, there is provided a hole in a center portion thereof through which the pilot swirler 31 passes to be supported. Also provided are eight holes around the hole of the center through which the main swirlers 32 pass so as to be supported.

Numeral 35 designates metal fixing members, which are each formed of a metal plate and is interposed to fix each of the eight main swirlers 32 to the inner circumferential wall of an end portion 36 of the combustor 20 by welding. As shown in FIG. 25, the main swirlers 32 are fixed to the inner circumferential wall of the end portion 36 of the combustor 20 via the fixing metal member 35. Although omitted in the illustration, a main fuel nozzle has its front end portion inserted into the main swirler 32 and a pilot fuel nozzle has its front end portion inserted into the pilot swirler 31. Main fuel injected from the main fuel nozzle mixes with air coming from the main swirler 32 to be ignited for combustion by a flame, the flame being made by pilot fuel coming from the pilot fuel nozzle together with air coming from the pilot cone 33 of the pilot swirler 31. The mentioned combustor 20 is arranged in several tens of pieces, 16 for example, in a circle around a rotor in a gas turbine cylinder for supplying therefrom a high temperature combustion gas into a gas turbine combustion gas path for rotation of the rotor.

In the gas turbine combustor so made as a welded structure, a deformation occurs due to vibration or thermal stress in operation so as to cause cracks in the welded portion of the metal fixing member 35. This requires frequent repair work to replace the fixing metal member 35 or carry out additional welding work. In the fitting portion of the metal fixing member 35, there is only a narrow space for welding work, creating a bad condition for performing a satisfactory welding. As such, a high level of skill of the workers is required. Also, in making the welded structure, a fine adjustment in fitting is difficult, which restricts maintaining accuracy. That is, there is a problem in the work accuracy in making the welded structure.

Next, a problem existing in the pilot cone portion (X-4) will be described. In the combustor 20 described with respect to FIGS. 24 and 25, the main fuel nozzle is inserted into the central portion of the main swirler 32, and main fuel injected from the main fuel nozzle and air coming from the main swirler 32 are mixed together to form a premixture. On the other hand, the pilot fuel nozzle is inserted into the central portion of the pilot swirler 31, and pilot fuel injected from the pilot fuel nozzle together with air coming from the pilot swirler 31 burns to ignite the premixture of the main fuel for combustion in a combustion tube, which includes an inner tube and a connecting tube, to thereby produce the high temperature combustion gas.

FIG. 26 is a partial detailed cross sectional view of a fitting portion of the pilot cone 33 of FIG. 24. In FIG. 26, a cone ring 38 at its one end is fitted to an outer wall of the pilot cone 33 by welding W2. The cone ring 38 at the other end is fitted to a fitting member 39*b*, which is an integral part of a base plate 39, by welding W1. The pilot cone 33 is inserted into a cylindrical portion 39*a* of the base plate 39 and fixed to the base plate 39 by welding W3. An end portion 31*a* of the pilot swirler 31 is inserted into the pilot cone 33 to be fitted to the pilot cone 33 by welding W4. In the welding W4, a black arrow in FIG. 26 shows a direction in which the welding is carried out. Thus, the pilot cone 33 is fitted to the base plate 39 via the cone ring 38 by welding W3 and the pilot swirler 31 is fitted to the pilot cone 33 by welding W4. Hence, the base plate 39 fixes the central pilot swirler 31, the pilot cone 33 and the eight pieces of the main swirlers 32 by welding, as mentioned above, to support them in a base plate block.

Fitting work procedures of the mentioned welded fitting structure have the cone ring 38 first fitted around the fitting member 39*b* of the base plate 39 by welding 1, and then the pilot cone 33 is fitted to the cone ring 38 by welding W2. The pilot cone 33 is then fitted to the base plate 39 by welding W3 which is done around an end portion of the pilot cone 33. Thereafter, the pilot swirler 31 is inserted into the end portion of the pilot cone 33 to be fitted to the pilot cone 33 by welding W4 to be done therearound. Thus, in case the pilot cone 33 is to be uncoupled in the welded structure, the weldings W2, W3 and W4 need to be detached. But in the spaces around the weldings W2 and W3, there are arranged the main swirlers 32, making the work space very narrow. This results in the need to disassemble the entirety of the base plate block. In this situation, the accuracy of the welding is deteriorated and becomes easily influenced by the thermal stress of the high temperature gas.

As the pilot swirler 31 and the pilot cone 33 are continuously influenced by the high temperature combustion gas, and the base plate block is made with a thin plate structure, as mentioned above, cracks easily arise due to strain caused by the thermal stress. This necessitates frequent repair work with a high level of welding skill, and thus an improvement of such welded structure is desired.

Next, a problem existing in the tail tube cooling portion (X-5) will be described. In the recent tendency toward higher temperature gas turbines, a combustor is being developed in which the combustion gas reaches a high temperature of about 1500° C., and the cooling system thereof is being tried to be changed to a steam type cooling system from an air type cooling system. FIG. 27 is an explanatory view showing a tail tube cooling structure in a representative gas turbine combustor in the prior art, which has been developed by the present applicants, wherein FIG. 27(*a*) is an entire view, FIG. 27(*b*) is a perspective view showing a portion of a tail tube wall and FIG. 27(*c*) is a cross sectional view taken on line J—J of FIG. 27(*b*). In FIG. 27(*a*), numeral 20 designates a combustor, which comprises a combustion tube and a tail tube 24. Numeral 22 designates a pilot fuel nozzle, which is arranged in a central portion of the combustion tube, and numeral 21 designates main fuel nozzles provided in eight pieces around the pilot fuel nozzle 22. Numeral 26 designates a main fuel supply port, which supplies the main fuel nozzles 21 with fuel 141. Numeral 27 designates a pilot fuel supply port, which supplies the pilot fuel nozzle 22 with pilot fuel 140.

Numeral 125 designates a cooling steam supply pipe for supplying therethrough steam 133 for cooling. Numeral 126 designates a cooling steam recovery pipe for recovering therethrough recovery steam 134 after being used for cooling of the tail tube 24 of the combustor. Numeral 127 designates a cooling steam supply pipe, which supplies therethrough cooling steam 132 from a tail tube outlet portion for cooling of the tail tube 24, as described later.

In FIG. 27(*b*), showing a portion of a wall 20*a* of the tail tube 24, there are provided a multiplicity of steam passages 150 in the wall 20*a*. Steam passing therethrough cools the wall 20*a*. In FIG. 27(*c*), a steam supply hole 150*a* and a steam recovery hole 150*b* are provided to communicate with the steam passages 150 so that steam supplied through the steam supply hole 150*a* flows through the steam passages 150 for cooling of the wall 20*a* and is then recovered through the steam recovery hole 150*b*.

In the combustor so constructed, the main fuel 141 is supplied into the eight pieces of the main fuel nozzles 21 from the main fuel supply port 26. On the other hand, the pilot fuel 140 is supplied into the pilot fuel nozzle 22 from the pilot fuel supply port 27 to be burned for ignition of the main fuel injected from the surrounding main fuel nozzles 21. Combustion gas of high temperature thus flows through the combustion tube and the tail tube 24 to be supplied into a combustion gas path of a gas turbine (not shown), and while flowing between stationary blades and moving blades, works to rotate a rotor. The combustor so constructed is arranged in various plural pieces according to the model or type, for example 16 pieces, around the rotor. The high temperature gas of about 1500° C. flows in the outlet of the tail tube 24 of each of the combustors. Thus, the combustor 20 needs to be cooled by air or steam.

In the combustor of FIG. 27, a steam cooling system is employed. The cooling steam 132, 133, extracted from a steam source (not shown), is supplied through the cooling steam supply pipes 127, 125, respectively, to flow through the multiplicity of steam passages 150 provided in the wall 20*a* of the tail tube 24 for cooling of the wall 20*a*. The cooling steam then joins together in the cooling steam recovery pipe 126 to be recovered as the recovery steam 134 to be returned to the steam source for effective use thereof.

FIG. 28 is a view seen from plane K—K of FIG. 27(*a*) to show an outlet portion of the tail tube 24. Numeral 160 designates a combustion gas path, through which the high temperature combustion gas of about 1500° C. is discharged. A flange 71 for connection to the gas turbine combustion gas path is provided at an end periphery of the outlet portion of the tail tube 24. FIG. 29 is a cross sectional view taken on line L—L of FIG. 28 to show a steam cooled structure of the tail tube outlet portion in the prior art. In FIG. 29, the multiplicity of steam passages 150 are provided in the wall 20*a*, as mentioned above, in parallel with each other. A cavity 75 is formed over the entire inner circumferential peripheral portion of the flange 71 of the tail tube 24 outlet portion and the multiplicity of steam passages 150 communicate with the cavity 75.

A manifold 73 is formed, being covered circumferentially by a covering member 72, between an outer surface portion of the wall 20*a* of the tail tube 24 and the flange 71. The respective steam passages 150 communicate with the manifold 73 via respective steam supply holes 74.

In the mentioned steam cooled structure, a high temperature combustion gas 161 of about 1500° C., on the one hand, flows in the combustion gas path 160, and on the other hand, the temperature of air flowing outside of the manifold 73 within the turbine cylinder is about 400 to 500° C. An inner peripheral surface portion of the wall 20*a* and that of the tail tube 24 outlet portion, which are exposed to the high temperature combustion gas 161, are sufficiently cooled by the cooling steam 132 flowing into the steam passages 150 from the manifold 73 via the steam supply holes 74. The steam in the cavity 75 cools also a portion 20*b* which is not exposed to the high temperature combustion gas 161 and the cooling steam 132 in the manifold 73 also cools a portion 20*c*. Hence, as compared with the inner wall 20*a*, the portions 20*b* and 20*c* are excessively cooled, causing a differential thermal stress between the wall 20*a* and the portions 20*b* and 20*c*, thereby causing unreasonable forces therearound, which results in the possibility of cracks occurring, etc.

The gas turbine combustor in the prior art as described above is what is called a two stage combustion type gas turbine combustor, effecting a pilot combustion and a main combustion at the same time. The pilot combustion is done such that fuel is supplied along the central axis of the combustor, and combustion air for burning this fuel is supplied therearound to form a diffusion flame (hereinafter referred to as a pilot flame) in the central portion of the combustor. Main combustion is done such that a main fuel premixture having a very high excess air ratio is supplied around the pilot flame so as to make contact with a high temperature gas of the pilot flame to thereby form a premixture flame (hereinafter referred to as a main flame). FIG. 30 is a conceptual view of such a two stage combustion type gas turbine combustor in the prior art.

With reference to FIG. 30, within a liner 252 of the combustor 20, the pilot fuel nozzle 22 for injecting a pilot fuel is provided along a central axis O' and a pilot air supply passage 256 is provided around the pilot fuel nozzle 22. The pilot swirler 31 for flame holding is provided in the pilot air supply passage 256. Further, the main fuel nozzles 21, main air supply passages 258 and the main swirlers 32 for supplying main fuel are provided around the pilot air supply passage 256.

The pilot cone 33 is provided downstream of the pilot fuel nozzle 22 and the pilot air supply passage 256. The fuel supplied from the pilot fuel nozzle 22 and the air supplied from the pilot air supply passage 256 effect a combustion in a pilot combustion chamber 262 formed by the pilot cone 33 to form the pilot flame as shown by arrow 266. The fuel supplied from the main fuel nozzles 21 and the air supplied from the main air supply passages 258 are mixed together in a mixing chamber 264 downstream thereof to form the premixture as shown by arrow 268. This premixture 268 comes in contact with the pilot flame 262 to form the main flame 270.

In the prior art combustor 20, as the pilot flame 266 and the premixture 268 come in contact with each other in a comparatively short time, the premixture 268 is ignited easily, whereby the main flame 270 burns over a comparatively short length in the axial direction or the main flow direction, and is thus liable to form a short flame. If the combustion is over such a short length, or in other words, in a narrow space, a concentration of energy released by the combustion in the space or a cross sectional combustion load of the combustor becomes high to easily cause combustion vibration. Combustion vibration is a self-induced vibration caused by a portion of the thermal energy being converted to vibration energy, and as the cross sectional combustion load of the combustor becomes higher, the exciting force of the combustion vibration becomes larger and the combustion vibration becomes more liable to occur. As mentioned above, in the prior art combustor, the combustion load is comparatively high and there is a problem that the combustion becomes unstable due to the combustion vibration.

SUMMARY OF THE INVENTION

In the prior art gas turbine combustor as described above, mainly with reference to FIG. 20, non-uniformity of the air intake in the air intake portions (X-1) and (X-2), influence of the thermal stress due to the work process and work accuracy of the welded structures of the fitting portions of the main swirlers (X-3) and of the pilot cone (X-4), influence of the thermal stress due to non-uniformity of cooling of the tail tube cooling portion (X-5), etc. are obstacles in attaining higher temperature and higher efficiency of the gas turbine combustor. For realization thereof, further improvements of the mentioned portions of (X-1) to (X-5) are desired strongly.

Thus, it is an object of the present invention to provide a gas turbine combustor which makes uniform the air intake in the air intake portions (X-1) and (X-2) and realizes an optimal combustion air quantity therein, employs a fitting structure to mitigate the influence of the thermal stress in the thermally severest portions of the main swirler portion (X-3) and the pilot cone portion (X-4) and also employs a cooling structure to ensure a cooling uniformity of the tail tube cooling portion (X-5) to thereby totally solve the problems accompanying the higher temperature of the combustor, so as to realize a higher performance thereof.

Also, it is an object of the present invention to provide a gas turbine combustor having reduced combustion vibration.

In order to attain the object, the present invention provides the following (1) to (9).

(1) A gas turbine combustor is constructed such that an inner tube, a connecting tube and a tail tube are arranged to be connected sequentially from a fuel inlet side. The inner tube comprises a pilot swirler arranged in a central portion of the inner tube and a plurality of main swirlers arranged around the pilot swirler. The pilot swirler and each of the main swirlers at their respective end portions pass through a circular base plate to be supported. The circular base plate is supported by being fixed to an inner circumferential surface of the inner tube and an outlet portion of the tail tube is connected to a gas turbine inlet portion. The inner tube comprises an air intake for making the air intake into the combustor uniform. The pilot swirler or each of the main swirlers comprises a holding means for mitigating thermal stress and the outlet portion of the tail tube comprises a cooling means for attaining uniform cooling.

In the present invention of (1) above, which is a basic embodiment of the invention, the air intake makes the air flowing into the combustor uniform. The air quantity flowing into the inner tube through air holes provided in the circumferential wall of the inner tube is adjusted to an appropriate quantity, whereby good combustion is attained with less formation of $NO_x$ and colored smoke generated by combustion is suppressed as well. Also, by the holding means, the structural portions, such as the pilot swirler and the main swirlers, which are liable to receive thermal stress, influences are made such that the thermal stress is absorbed, repair and inspection become easy and welding of a high accuracy becomes possible, whereby shortcomings such as weld cracks, etc. can be suppressed. Further, by the cooling of the tail tube, in case steam cooling is employed, non-uniformity of the cooling of the tail tube outlet portion is avoided. By the uniform cooling at this portion, cracks due to thermal stress, etc. can be prevented. Thus, according to the present invention of (1) above, combustion uniformity in higher temperature gas turbine and structural portions subject to severe thermal stress are improved. The cooling structure to attain the uniform cooling to prevent the generation of thermal stress at the tail tube outlet portion is employed, with the result that the performance enhancement of the gas turbine combustor using higher temperature combustion gas becomes possible.

(2) A gas turbine combustor as mentioned in (1) above may have the air intake constructed such that a rectifier tube is provided to cover the surroundings of the inner tube on the fuel inlet side, maintaining a predetermined space from the inner tube. The rectifier tube is at one end fixed to a turbine cylinder wall and is open at the other end.

In the present invention of (2) above, the air supplied from the compressor flows in around the combustor from the other end of the rectifier tube, and while it flows through the predetermined space between the rectifier tube and the combustor inner tube, it is rectified to be a uniform flow of an appropriate quantity, and then flows into the combustion chamber through the gaps formed by the plural supports. The air flow is a uniform flow without bias so that the fuel concentration at the nozzle outlet becomes uniform, whereby good combustion is attained and an increase of $NO_x$ formation can be suppressed. The mentioned rectifier tube may be applied to either a combustor of a type having a wider space in the combustor air inflow portion in the turbine cylinder, or what is called a top hat type combustor having the air inflow portion being covered by a casing, with the same effect being obtained in both cases.

(3) A gas turbine combustor as mentioned in (2) above may have the rectifier tube at one end comprising a sloping portion in which the diameter thereof contracts gradually.

In the present invention of (3) above, the rectifier tube at its one end comprises the sloping portion in which the diameter of the rectifier tube contracts gradually. The air flowing therein thereby strikes the inner circumferential surface of the sloping portion and changes the direction of flow entering the combustion chamber smoothly so that the air flows uniformly toward the central portion of the combustor with increased rectifying effect. Hence the effect of the invention of (2) above is ensured further.

(4) A gas turbine combustor as mentioned in (1) above may have the air intake constructed such that a plurality of air holes are provided in a circumferential wall of the inner tube, being arranged in a plurality of rows in a flow direction of the combustion gas flowing from upstream to downstream in the inner tube. Where air supplied from a fuel nozzle portion for combustion of the fuel, air supplied for cooling of the combustor and air supplied into the inner tube through the plurality of air holes are a total quantity of air, air supplied into the inner tube through the air holes of a most downstream row of the plurality of rows is 7 to 12% thereof In the gas turbine combustor, there are three portions of air flow thereinto, that is, air used for combustion of fuel supplied from the main fuel nozzles and the pilot fuel nozzle, air flowing into the inner tube through cooling holes provided in the inner tube wall for cooling of the inner tube and air flowing into the inner tube through air holes for burning unburnt components of the fuel. The air holes are provided in the circumferential wall of the inner tube as plural holes arranged in plural rows, three rows for example, in the gas flow direction in the inner tube. In the prior art, the air quantity flowing in each of the two rows on the upstream side is the same as each other, and that flowing in the row at the most downstream side is more than that, for example about 20% of the entire air quantity of the three portions. If the air flowing into the inner tube through the air holes of the most downstream row becomes excessive at a low load time, the combustion gas is cooled to increase the amount of colored smoke. In the present invention of (4) above, however, the air quantity entering through the air holes of the most downstream row is suppressed to 7 to 12% of the entire air quantity, which is approximately half of the prior art case, and hence generation of the colored smoke can be suppressed.

(5) A gas turbine combustor as mentioned in any one of (1) to (4) above may have the holding means constructed such that each of the plurality of main swirlers, at an inlet portion thereof, is fixed to an inner circumferential surface of the inner tube via a fitting member. The fixing of each of the main swirlers and the fitting member to the inner tube is done by a bolt joint.

In the present invention of (5) above, the main swirler at its outlet end portion, as well as the pilot swirler, are supported by the base plate, and the base plate is fitted to the inner circumferential surface of the combustor. Also, the main swirler at its inlet end portion is jointed to the inner circumferential surface of the combustor by the bolt via the fitting member, whereby the fitting work becomes easy, fine adjustment for the fitting can be done easily and accuracy of the fitting position is enhanced.

The holding structure is a welded structure in the prior art, so that cracks occur easily in the welded portions of the fitting member of the main swirler due to thermal stress, etc. In operation, there is a limitation to the accuracy of the product made in the welded structure of thin metal plates and deformation occurs due to residual strain in the welded portions in addition to the thermal stress so as to cause mutual contact of the main swirler and the main fuel nozzles, increasing abrasion. Further, there is only a narrow space for welding work of the fitting member to deteriorate the workability. But in the present invention of (5) above, the shortcomings are improved to enhance reliability of the product, and the manufacturing cost thereof is reduced as well.

(6) A gas turbine combustor as mentioned in any one of (1) to (4) above may have the holding means constructed such that an outer diameter of an inlet end portion of a pilot cone, which is arranged on an outlet side of the pilot swirler, is made approximately equal to an outer diameter of an outlet end portion of the pilot swirler so that the inlet end portion of the pilot cone abuts on the outlet end portion of the pilot swirler. Welding is applied at this point from inside of the pilot cone to joint the pilot swirler and the pilot cone together.

In the present invention of (6) above, the pilot swirler passes through the central cylindrical portion of the base plate to be supported and the inlet portion end of the pilot cone abutting thereon is jointed by welding, which is done from inside of the pilot cone. In case the pilot cone is damaged by burning in operation so as to require replacement thereof, the welded portion of the pilot cone is thereby removed from the inside thereof, and the welded portion of the pilot cone and the fitting member of the base plate is also removed, so that the pilot cone only can be taken out easily and the replacement work thereof is done easily. In the prior art, if the pilot cone was to be detached, the entire swirler needed to be disassembled in each of the base plate blocks. But the welded structure of the present invention is made such that the pilot swirler is first fitted to the base plate and then the pilot cone is welded to the pilot swirler. The welding is done from inside of the pilot cone, so that detachment of the pilot cone can be done easily, replacement thereof becomes easy and workability thereof is improved. With such a welded structure, accuracy of the welding is enhanced and reliability in attaining the higher temperature of the gas turbine is also enhanced.

(7) A gag turbine combustor as mentioned in any one of (1) to (4) above may have the cooling means constructed such that a steam manifold is closed by a covering member to cover an outer circumference of an outlet portion of the tail tube and an end flange of the outlet portion of the tail tube. A plurality of steam passages are provided in a wall of the tail tube extending from the connecting tube to near the end flange of the tail tube. The plurality of steam passages communicate with the steam manifold and a cavity formed over an entire inner circumferential portion of the outlet portion of the tail tube near the end flange. The steam manifold is partitioned therein by a rib to form two hollows, one on the side of the end flange for covering at least an outer side of the cavity and the other for steam flow therein.

In the present invention of (7) above, the hollow is provided to cover the outer circumferential surface of the tail tube outlet portion near the end flange, and this hollow covers also the outer side of the cavity. Thus, the outer side of the cavity makes contact with the air layer in the hollow so as not to be cooled directly by the steam in the steam manifold. In the prior art, the outer side of the cavity is cooled directly by the steam in the cavity and in the steam manifold so as to be excessively cooled, which causes a differential temperature between the inner circumferential surface of the tail tube outlet portion and the outer side structural components, causing thermal stress. But in the present invention, such excessive cooling is avoided by mitigating the differential temperature between the tail tube outlet portion and the outer side components, and the thermal stress caused thereby can also be mitigated.

(8) A gas turbine combustor as mentioned in any one of (1) to (7) above may have shield gas supplied between the pilot air and the main combustion premixture. The pilot air is supplied from the pilot swirler and the main combustion premixture is formed by main air supplied from the main swirlers and main fuel being mixed together.

In the present invention of (8) above, the pilot fuel is burned by the pilot air, whereby the pilot flame which comprises the diffusion flame is formed. As in the prior art case, the main combustion premixture makes contact with the pilot flame to burn as the premixture combustion. The shield gas supplied around the pilot air suppresses mutual contact of the premixture and the pilot flame, whereby the combustion velocity of the premixture is reduced, the main flame, as the premixture flame formed between the premixture and the pilot flame, becomes longer in the longitudinal direction of the combustor and the combustion energy concentration is lowered.

(9) A gas turbine combustor as mentioned in (8) above may have the shield gas be a recirculated gas of exhaust gas produced by combustion in the gas turbine combustor.

In the present invention of (9) above, the shield gas is supplied from the recirculated gas of the gas turbine exhaust gas, whereby the oxygen concentration in the premixture flame is reduced and $NO_x$ formation is suppressed.

DESCRIPTION OF THE PREFERRED EMBODIMENTS

Figure 1:
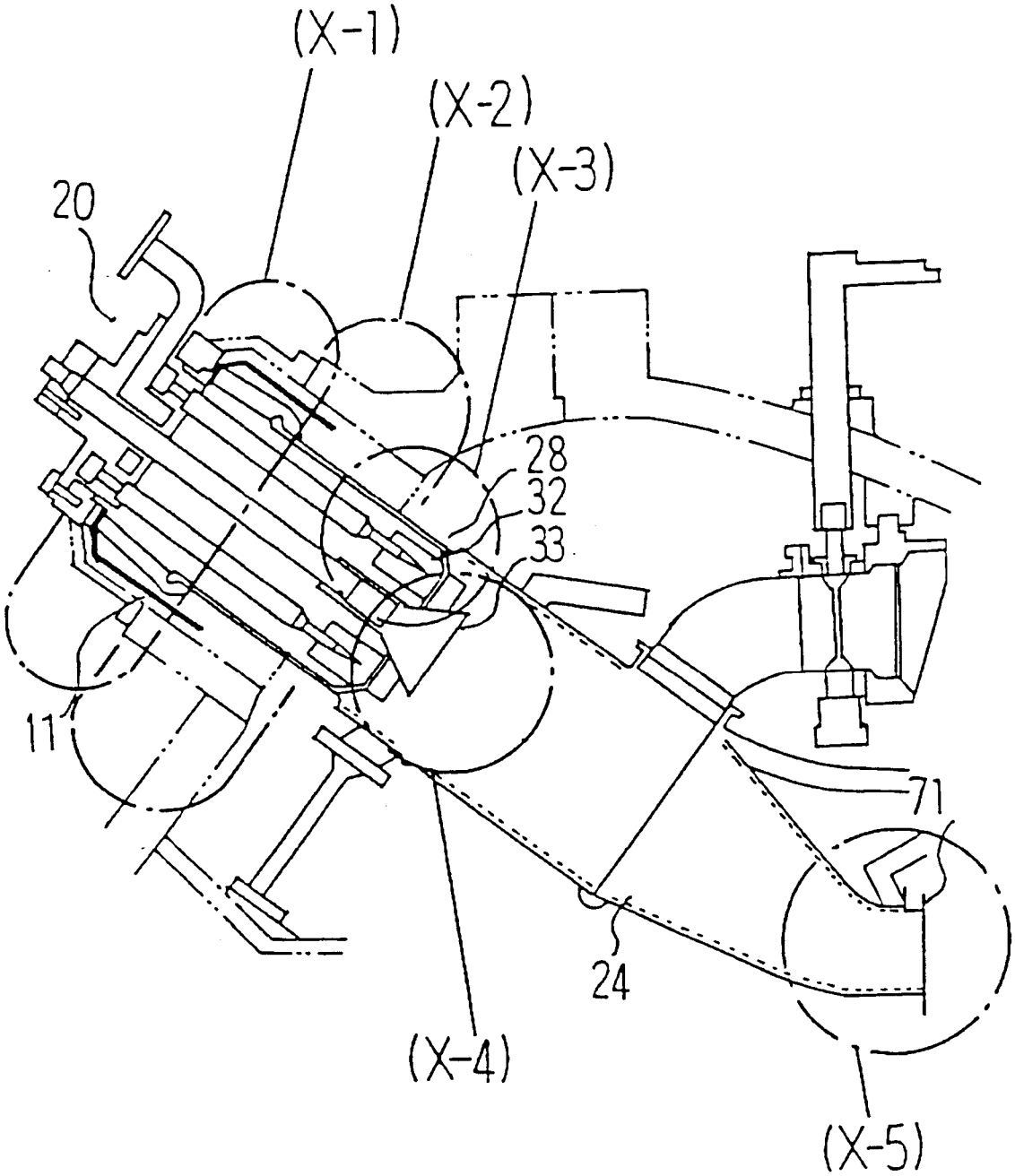
FIG. 1 is a constructional view of a gas turbine combustor showing entire portions of embodiments according to the present invention.
Figure 21:
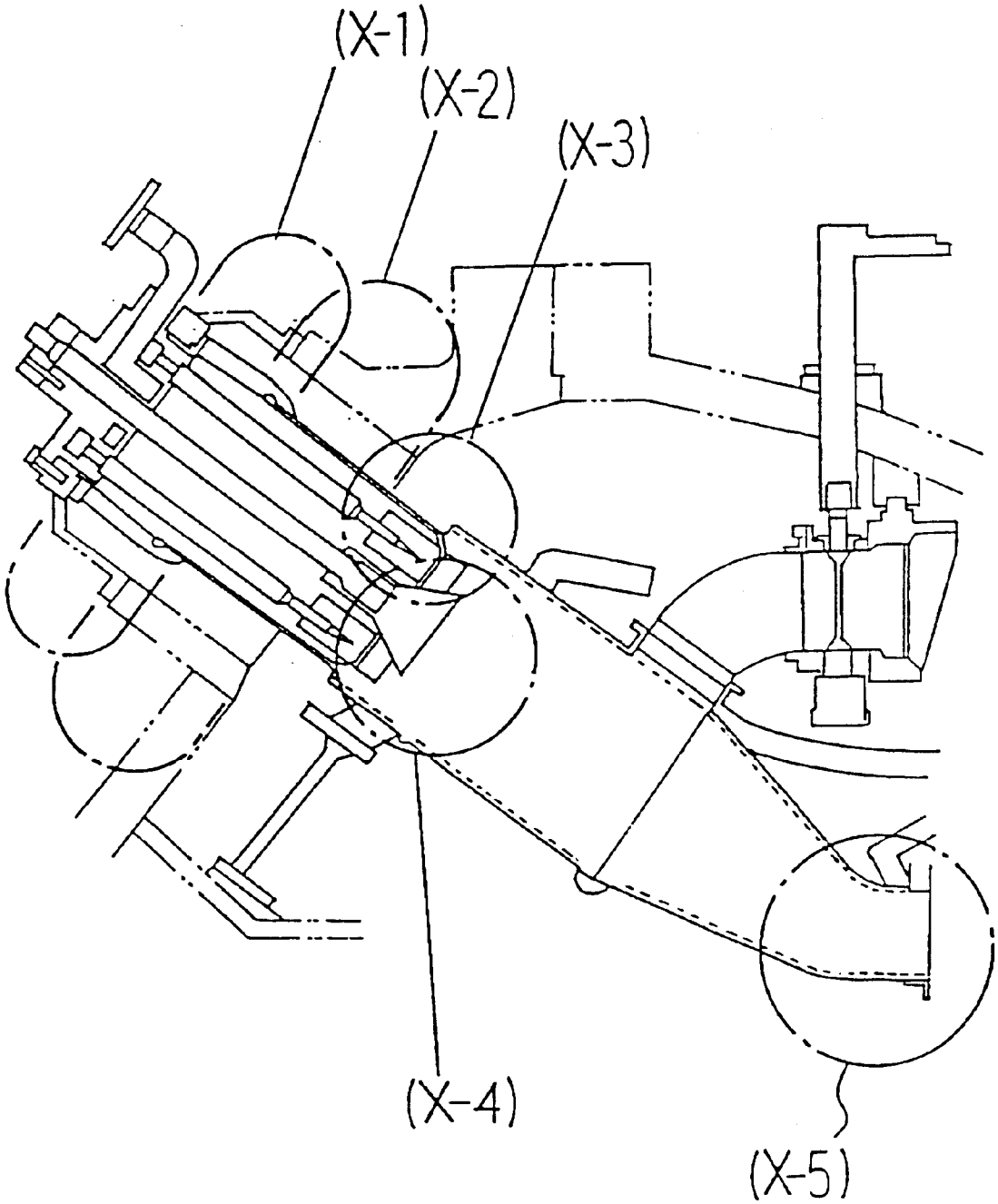
Fig. 21 (Prior Art)
FIG. 21 is an enlarged schematic view of the gas turbine combustor of FIG. 20.
Figure 22:
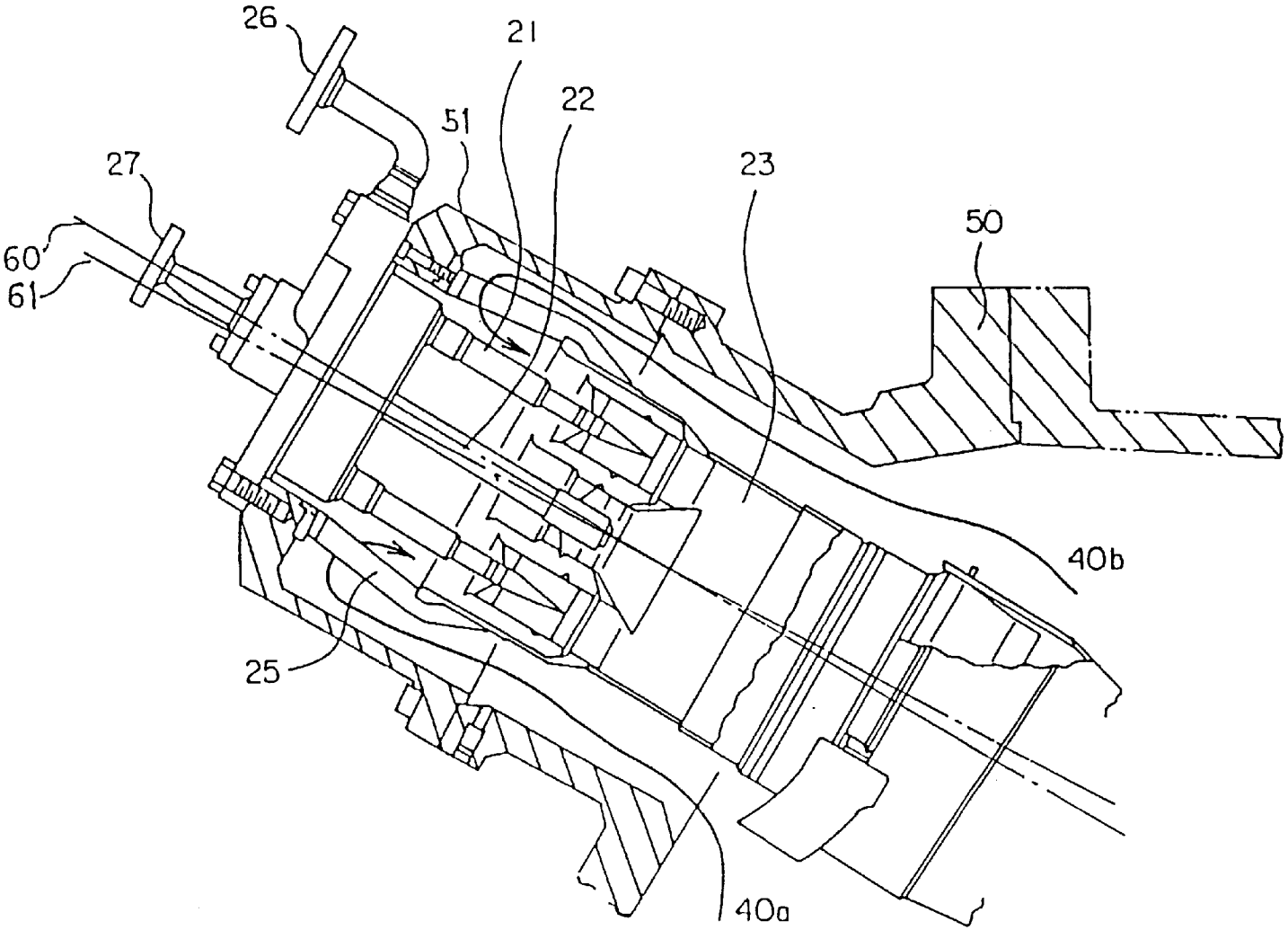
Fig. 22 (Prior Art)
FIG. 22 is a cross sectional view of a top hat type fuel nozzle portion of a prior art gas turbine.

Herebelow, embodiments according to the present invention will be described with reference to the figures. The present invention solves various problems existing in the gas turbine combustor as described before with respect to FIG. 21, and FIG. 1 shows the entire construction thereof. In FIG. 1, an (X-1) portion as a first embodiment, an (X-2) portion as a second embodiment, an (X-3) portion as a third embodiment, an (X-4) portion as a fourth embodiment, an (X-5) portion as a fifth embodiment and a case to solve a combustion vibration problem as a sixth embodiment will be described sequentially below.

Figure 2:
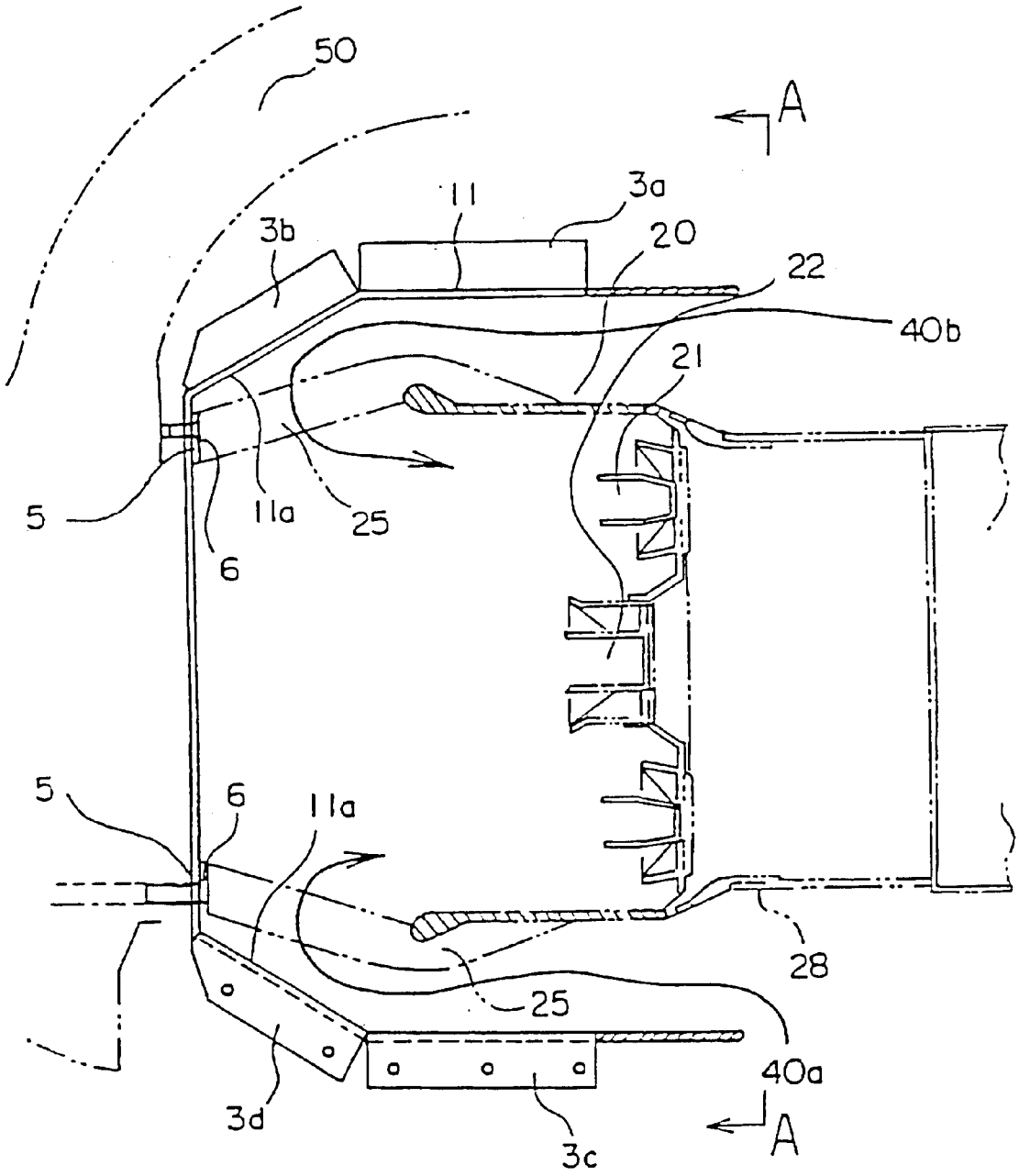
FIG. 2 is a cross sectional view showing a fitting state of a rectifier tube of a gas turbine combustor of a first embodiment.
Figure 3:
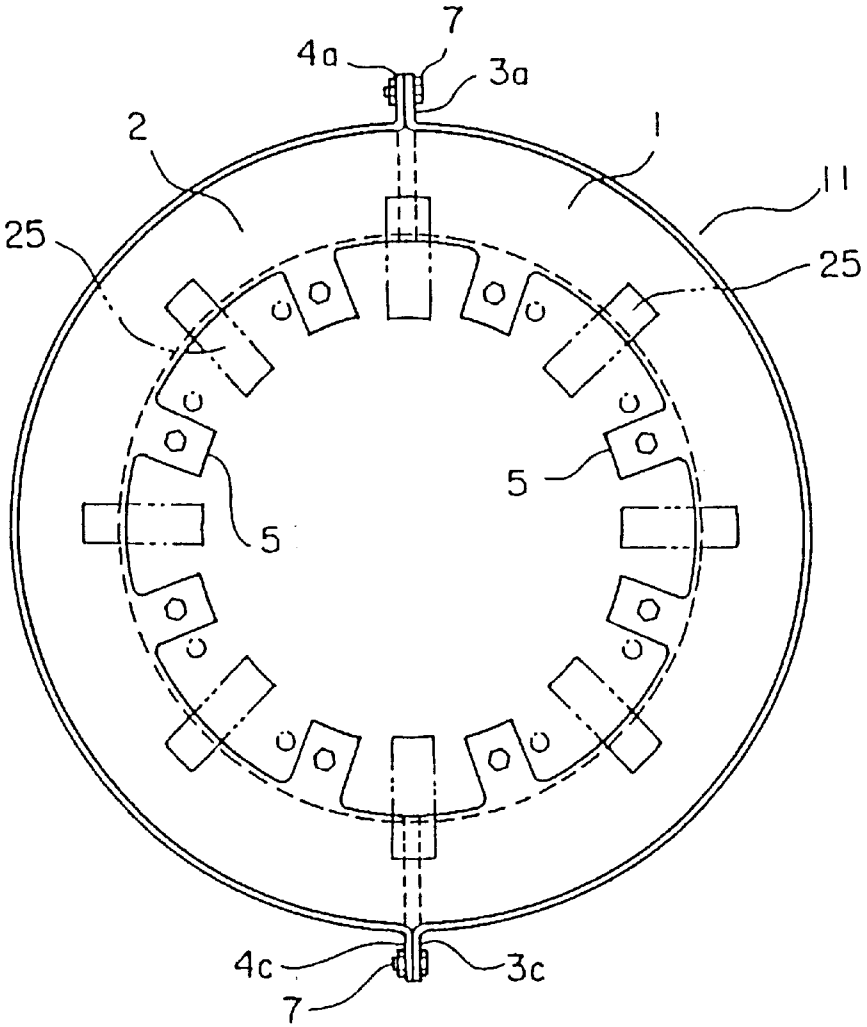
FIG. 3 is a cross sectional view taken on line A—A of FIG. 2.
Figure 4:
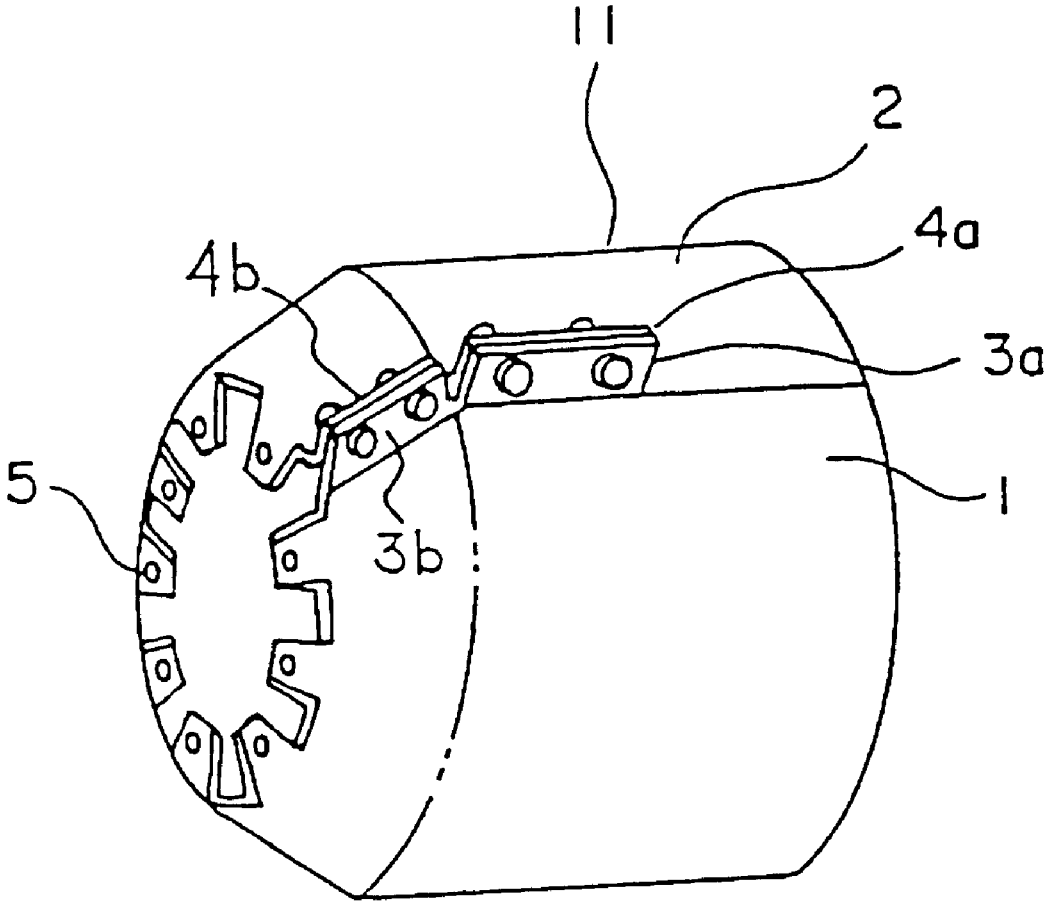
FIG. 4 is a perspective view of the rectifier tube of FIG. 2.

The first embodiment in the (X-1) portion will be described with reference to FIGS. 2 to 6. FIG. 2 is a cross sectional view showing a fitting state of a rectifier tube of the gas turbine combustor of the first embodiment, FIG. 3 is a cross sectional view taken on line A—A of FIG. 2, and FIG. 4 is a perspective view of the rectifier tube of FIG. 2. In FIG. 2, a combustor 20 is contained in a turbine casing 50 and a plurality of supports 25 are fitted to and around an outer periphery of an inner tube 28 with a predetermined interval being kept between each of the supports 25. A rectifier tube 11 is provided so as to surround and cover the supports 25 with a predetermined space being kept between itself and the inner tube 28 or the supports 25. The rectifier tube 11 has fitting flanges 5 fixed by bolts 6 to the turbine casing 50 near end portions of the supports 25.

In FIG. 3, the rectifier tube 11 is made by combining a casing 1 and a casing 2, both of a semicircular cross sectional shape. The casing 1 is provided with flanges 3*a*, 3*b*, 3*c*, 3*d* (see FIG. 2) and the cylinder 2 is likewise provided with flanges 4*a*, 4*b*, 4*c*, 4*d* (4*b* and 4*d* are omitted in the illustration). These flanges are jointed together by bolts and nuts 7 to form the rectifier tube 11 of a circular cross sectional shape, wherein the flanges 3*a* and 4*a*, 3*b* and 4*b*, 3*c* and 4*c*, and 3*d* and 4*d* are jointed together, respectively.

The fitting flanges 5 of the rectifier tube 11 comprise plural pieces arranged around one end of the rectifier tube 11 of the cylindrical shape, as shown in FIG. 3. The other end of the rectifier tube 11 opens as an air inflow side. The fitting flange 5 side of the rectifier tube 11 opens also, and main fuel nozzles 21 and a pilot fuel nozzle 22 are inserted through this opening portion. An outside view of only the rectifier tube 11 so constructed is shown in FIG. 4.

In the gas turbine combustor so constructed, air 40*a*, 40*b* coming from a compressor flows around the inner tube 28 of the combustor 20 through the predetermined space between the inner tube 28 and the rectifier tube 11. The air is turned so as to be rectified by and around a sloping portion 11*a* of the rectifier tube 11, wherein a diameter of the rectifier tube 11 contracts gradually along the air flow direction. Thus, the rectified air 40*a*, 40*b* flows through gaps formed by the supports 25 to flow into the inner tube 28 uniformly.

As there had been no such rectifier tube 11 in the prior art, the air flowing around the combustor 20 flowed in through the gaps of the supports 25 from a comparatively wide space formed between an inner wall of the turbine casing 50 and the combustor 20. There is a wide space or a narrow space in that space, according to the place where the air flowed, and hence the air did not flow uniformly therein.

On the contrary, in the present embodiment, a predetermined space is covered and maintained by the rectifier tube 11 around the gaps of the supports 25 through which the air flows. The air, whose pressure and velocity are kept constant, flows into this space to further flow into the combustor 20 through the gaps of the supports 25. The air flow is rectified smoothly in its flow direction by the sloping portion of the rectifier tube 11 to uniformly flow into the combustor 20. Thus no biased flow of the air coming into the inner tube 28 occurs and a uniform fuel concentration is attained at nozzle outlet portions of the combustor 20, whereby $NO_x$ production can be suppressed.

Figure 5:
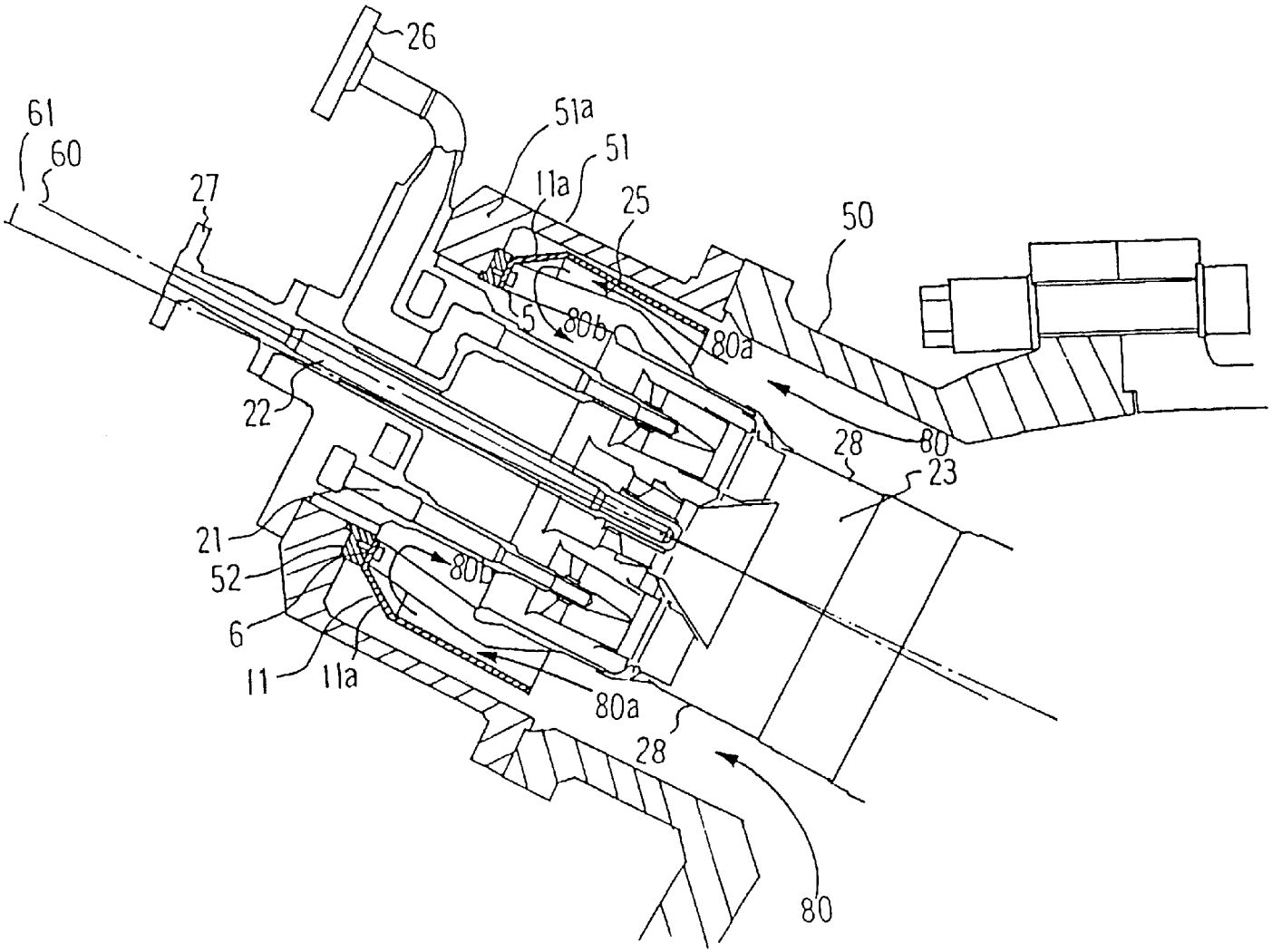
FIG. 5 is a cross sectional view of an example where the rectifier tube of the first embodiment is applied to another type, or a hat top type, of combustor.

FIG. 5 is a cross sectional view of an example where the rectifier tube 11 of the first embodiment is applied to another type, or a hat top type, of combustor. In FIG. 5, an outer tube casing 51 is provided to project toward the outside from a turbine casing 50 to form a fitting portion of an inner tube of the combustor. Such a combustor fitting structure is generally called a top hat type, wherein supports 25 support the inner tube 28 around main fuel nozzles 21 of the combustor and wherein the outer tube casing 51 and an outer tube casing cover 51*a* surround and cover the supports 25. Such outer tube casing 51 is arranged projecting around a rotor in the same number of pieces as the combustor to form an extension portion of the turbine casing 50.

The rectifier tube 11 is of a cylindrical shape and divided into two portions, as mentioned above. The rectifier tube 11 is provided with a plurality of fitting flanges 5 arranged circularly with a predetermined interval between each of the fitting flanges 5. The tube 11 is thus fitted to an inner tube fitting flange 52 by bolts 6 via the fitting flanges 5. A sloping portion 11*a* is formed so as to connect to the fitting flanges 5. The rectifier tube 11 is provided coaxially with a combustor central axis 60 and covers an air intake space. The tube 11 maintains a gap so as not to come in contact with an inner wall surface of the outer tube casing 51 and maintaining a uniform dimension of the space 5 around the supports 25.

In the combustor constructed as above, air 80 coming from a compressor flows in through an opening portion of the rectifier tube 11 to become a uniform flow 80*a* in the space between the rectifier tube 11 and the inner tube 28, and then turns in the space formed by the sloping portion 11*a* and the supports 25 to flow into the combustor as a turning flow 80*b*. In this turning flow 80*b*, as the uniform flow 80*a* enters along the sloping portion 11*a* of the rectifier tube 11, the flow turns smoothly to enter swirler portions in the space of the combustor, whereby a uniform swirled flow is produced and the combustion performance is enhanced.

Figure 6:
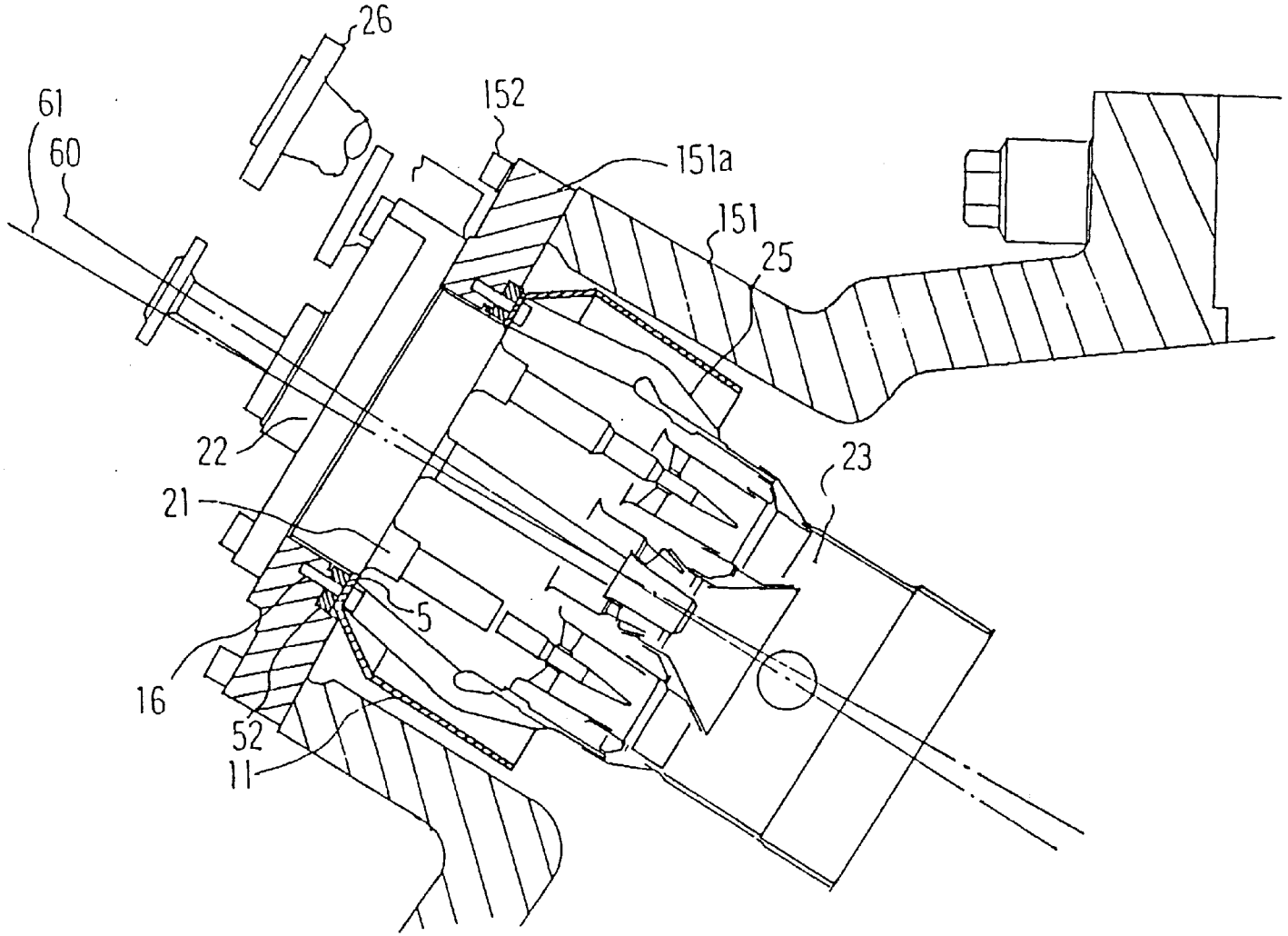
FIG. 6 is a cross sectional view of another example where the rectifier tube of the first embodiment is applied to still another type of combustor.

FIG. 6 is a cross sectional view of another example where the rectifier tube 11 of the first embodiment is applied to still another type of combustor in which the top hat structural portion of the combustor is divided. That is, an outer tube casing 151 is detachably fitted with an outer tube casing cover 151 a by a bolt 152 so that when the bolt 152 is unfastened, the outer tube casing, cover 151 a together with the combustor, may be taken out.

In FIG. 6, the rectifier tube 11 is constructed to be fitted to the outer tube casing cover 151*a* via fitting flanges 5 and an inner tube fitting flange 52 integrally by bolts 16. In this construction, there no exclusive bolt is needed for fitting the rectifier tube 11, whereby the structure of the fitting portion can be simplified. Other portions of the construction being the same as those of FIG. 5, the same effect as that of the example of FIG. 5 can be obtained.

Figure 7:
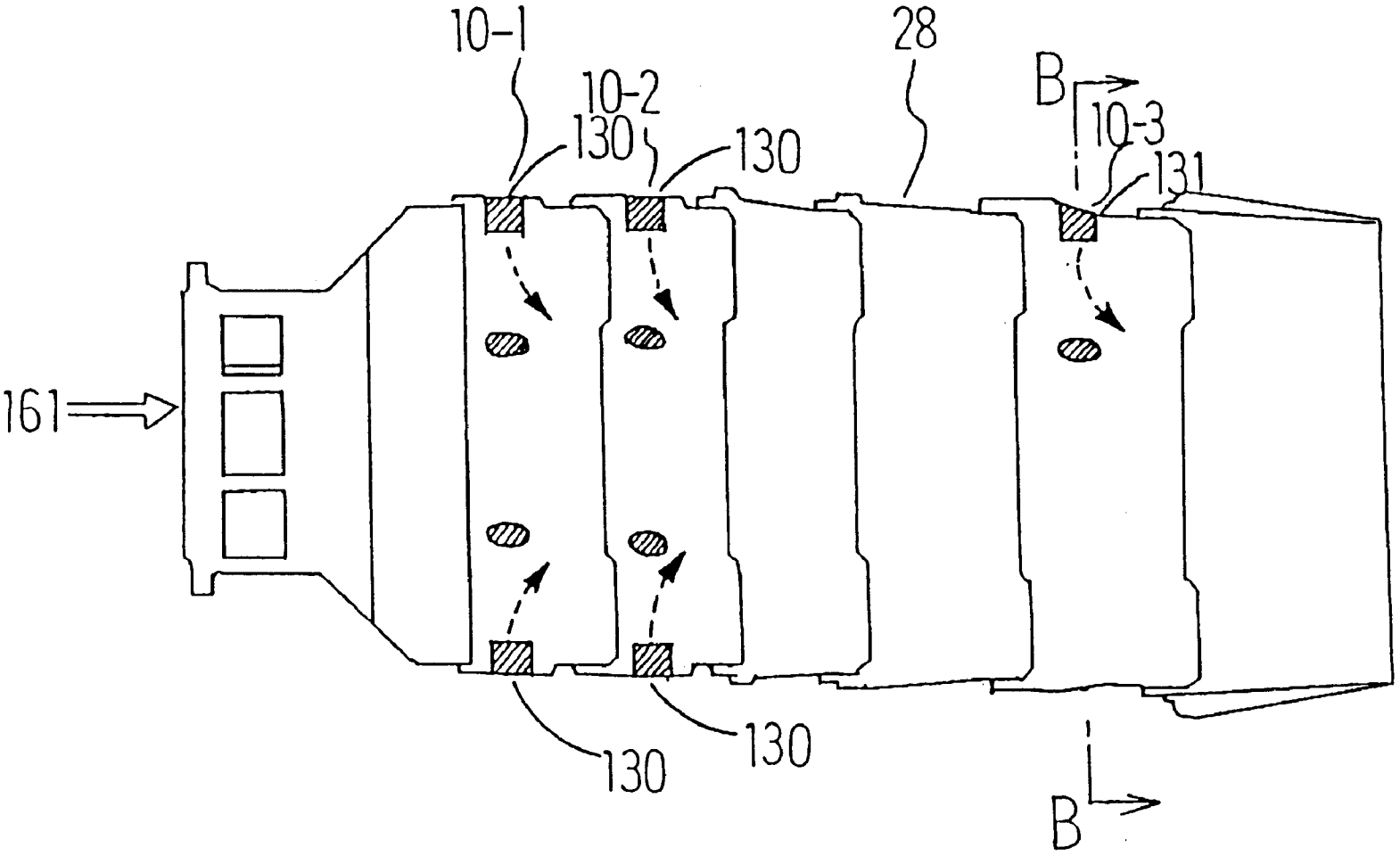
FIG. 7 is a side view of an inner tube portion of a combustor of a second embodiment according to the present invention.
Figure 23:
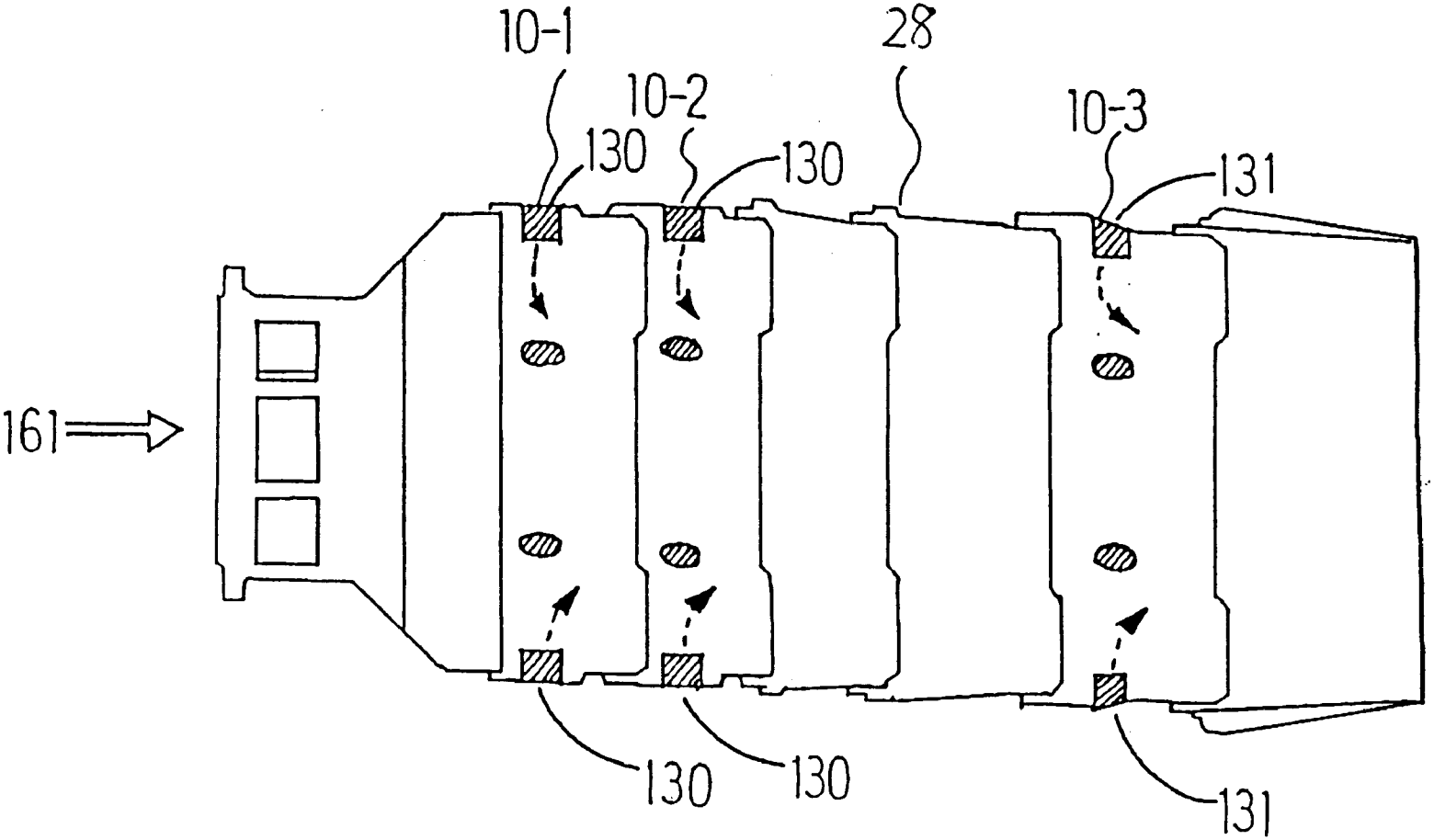
Fig. 23 (Prior Art)
FIG. 23 is a side view of an inner tube portion of the combustor of FIG. 20.

Next, a second embodiment in the (X-2) portion of the combustor of FIG. 1 will be described with reference to FIGS. 7 to 10. FIG. 7 is a side view of an inner tube portion of a combustor of the second embodiment. In FIG. 7, a high temperature combustion gas 161 flows into the inner tube 28. The high temperature combustion gas is produced by combustion of fuel injected from a pilot fuel nozzle and main fuel nozzles and air. In a circumferential surface of the inner tube 28, there are provided air holes 10-1 on an upstream side of the inner tube 28, the air holes 10-1 comprising six air holes arranged at equal intervals around the inner tube 28. Also, there are provided air holes 10-2 downstream of the air holes 10-1 comprising six air holes at equal intervals. Arrangement of these air holes 10-1, 10-2 is the same as that of the prior art shown in FIG. 23. In the present embodiment, air holes 10-3 on a downstream side of the inner tube 28 comprise only three air holes, which is less than the six in the prior art case, around the inner tube 28.

Figure 8:
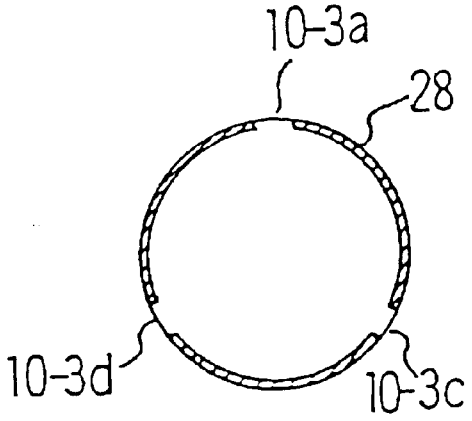
FIG. 8 are cross sectional views showing the arrangement of air holes of the inner tube, wherein FIG. 8(*a*) is a view taken on line B—B of FIG. 7 and FIG. 8(*b*) is a view showing a modified example of the air holes.
Figure 8:
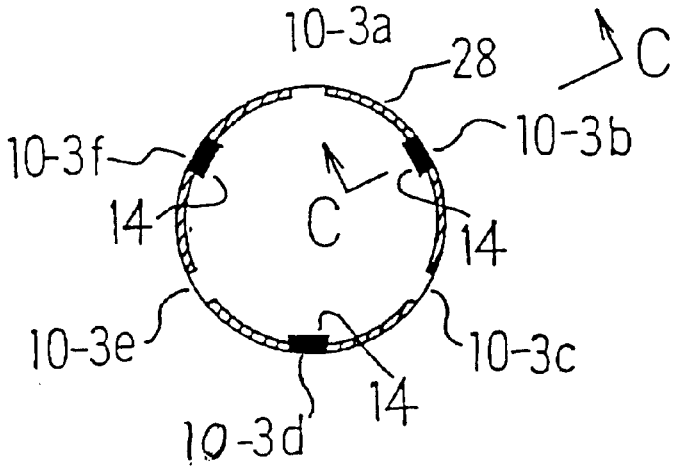

FIGS. 8 are cross sectional view showing arrangement of the air holes 10-3, wherein FIG. 8(*a*) is a view taken on line B—B of FIG. 7 and FIG. 8(*b*) is a view showing a modified example of the air holes 10-3. In FIG. 8(*a*), there are provided three air holes 10-3*a*, 10-3*b*, and 10-3*c* with equal intervals in the circumferential surface of the inner tube 28. In FIG. 8(*b*), six air holes 10-3*a*, 10-3*b*, 10-3*c*, 10-3*d*, 10-3*e*, and 10-3*f* as provided in the prior art are seen, and in order to arrange the air holes in three parts with equal intervals, the air holes 10-3*b*, 10-3*d*, and 10-3*f* are closed by plugs 14.

The air holes 10-3*a*, 10-3*c*, 10-3*e* only remain open, and there the same arrangement of three air holes as FIG. 8(*a*) is formed.

Figure 9:
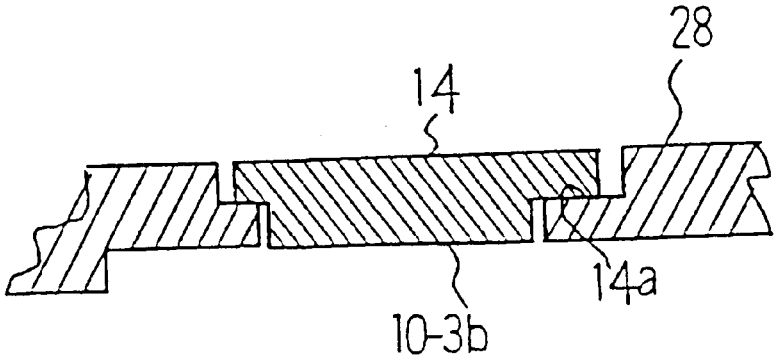
FIG. 9 is a cross sectional view taken on line C—C of FIG. 8(*b*).

FIG. 9 is a cross sectional view taken on line C—C of FIG. 8(*b*). In FIG. 9, the plug 14, being of a diameter which is slightly smaller than a hole diameter of the air hole 10-3*b*, has a flange 14*a* around a peripheral portion thereof and is fitted in the air hole 10-3*b* to be fixed by welding, etc. for closing of the hole. By the use of such plug 14, an existing inner tube can be used as is and, when so modified, can easily have the construction of the present second embodiment.

In the second embodiment constructed as above, the air entering the combustor 20 comprises three portions, as in the prior art case. That is, it includes the air used for combustion at the nozzle portion, the air entering the inner tube for cooling thereof through the small cooling holes and the air flowing into the inner tube through air holes 10-1, 10-2, and 10-3. Where the total quantity of the air is 100%, the quantity of the air flowing through the air holes 10-1 and 10-2 is about 14% each, as in the prior art case, and that of the air flowing through the air holes 10-3, having only the three holes as compared with the six holes in the prior art, is suppressed to about 7 to 12%.

If the respective air quantities of the air holes 10-1, 10-2, and 10-3 are expressed in a ratio, it is approximately 1:1:(0.5 to 0.85). As compared with the ratio in the prior art of 1:1:(1.3 to 1. 4), the air quantity entering the inner tube from the air holes 10-3 on the downstream side of the inner tube is reduced to approximately half. As a result of this, an appropriate air quantity is realized such that, while the air 131 entering through the air holes 10-3 on the downstream side of the inner tube is sufficient to be used for combustion of carbon remaining unburnt in the high temperature combustion gas 161, it is not so much so as to cool the high temperature combustion gas 161. Thus, the combustion efficiency is enhanced and the occurrence of a dark colored smoke in the exhaust gas can be prevented.

Figure 10:
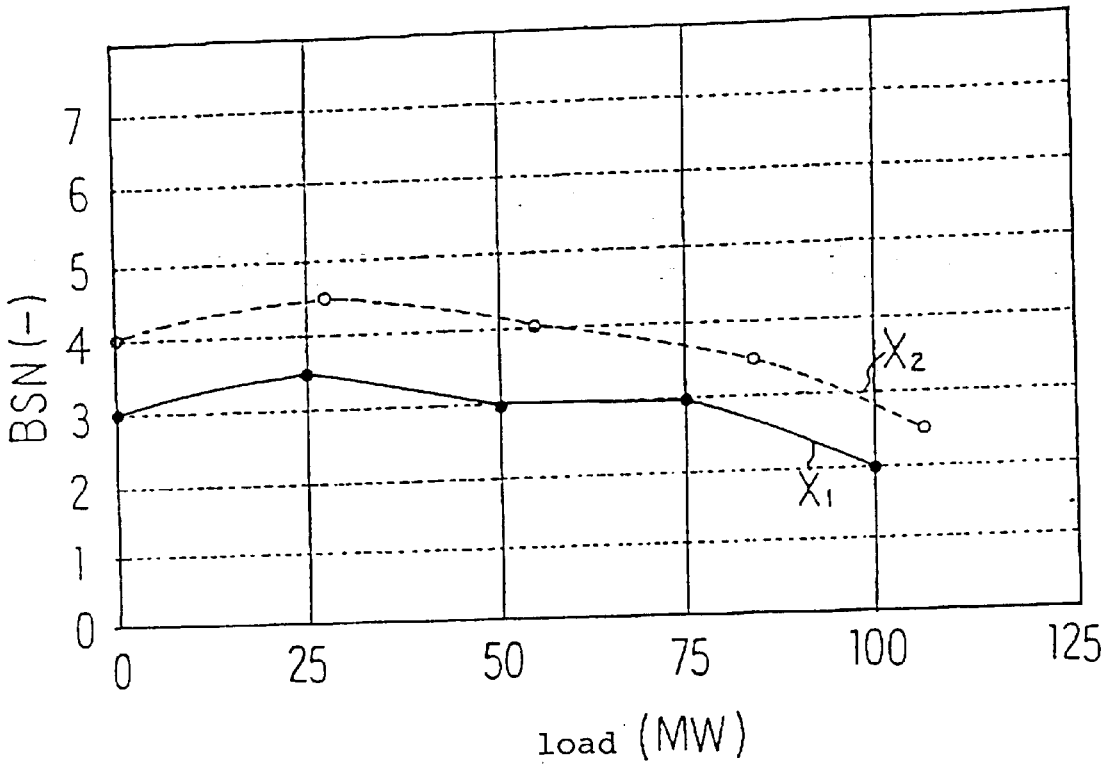
FIG. 10 is a graph showing a relation between smoke visibility and load as an effect of the second embodiment as compared with the prior art case.

FIG. 10 is a graph showing a relation between smoke visibility and load as an effect of the second embodiment as compared with the prior art case. In FIG. 10, the horizontal axis shows load and the vertical axis shows the value of a level of smoke visibility (BSN). As this value becomes larger, it means a thicker smoke color visible by human eyes, and as this value becomes smaller, it means a thinner smoke color that is less visible. According to the result, it is understood that smoke color $X_1$ of the combustor of the present embodiment is thinner than the color $X_2$ of the combustor in the prior art shown in FIG. 23. Thus there is obtained an effect of suppressing the occurrence of smoke.

Figure 11:
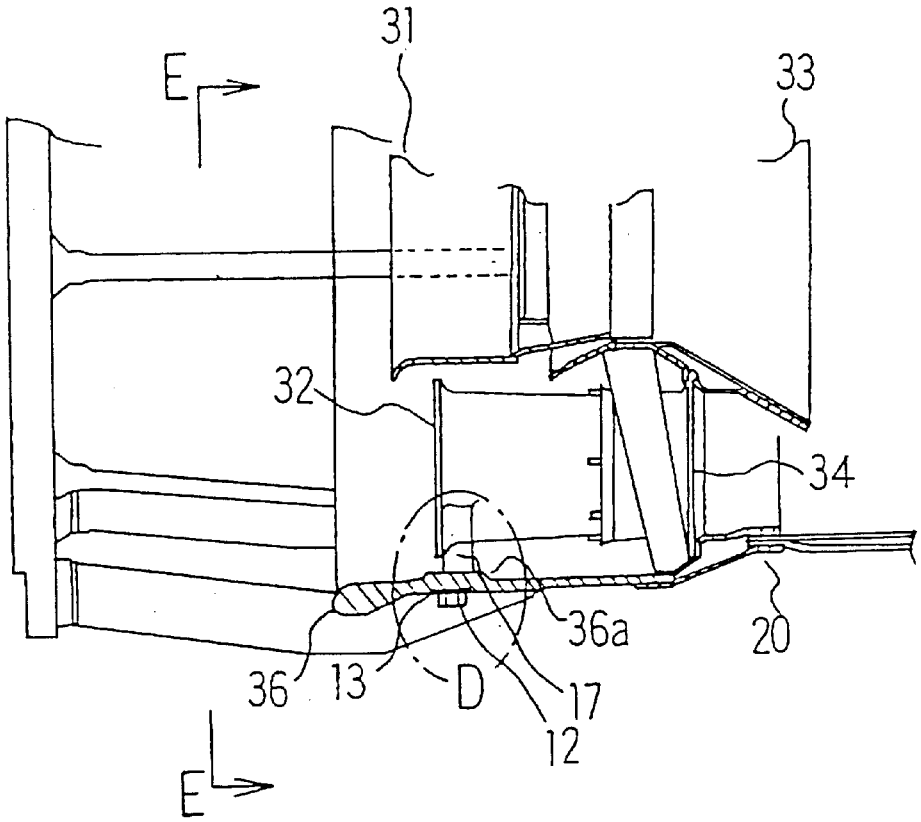
FIG. 11 is a partial cross sectional view of a main swirler of a combustor of a third embodiment according to the present invention.

Next, a third embodiment in the (X-3) portion of the combustor of FIG. 1 will be described with reference to FIGS. 11 to 14. FIG. 11 is a partial cross sectional view of a main swirler of a combustor of the third embodiment. In FIG. 11, a combustor 20 in its central portion has a pilot swirler 31 and a pilot cone 33 arranged at an end portion thereof. Eight main swirlers 32 are arranged around the pilot swirler 31. These swirlers 31 and 32 are fitted to a base plate 34 of circular shape, and the base plate 34 has its circumferential periphery welded to an inner wall of the combustor 20. This structure is the same as that existing in the prior art. A block 17 is fitted to an outer circumferential surface of an end portion of the main swirler 32. The main swirler 32 is fixed to the inner wall of an end portion of the combustor 20 via the block 17. The block 17 is fixed to the inner wall of the combustor 20 by a bolt 12, which passes through the wall of the combustor from the outside via a washer 13.

Figure 12:
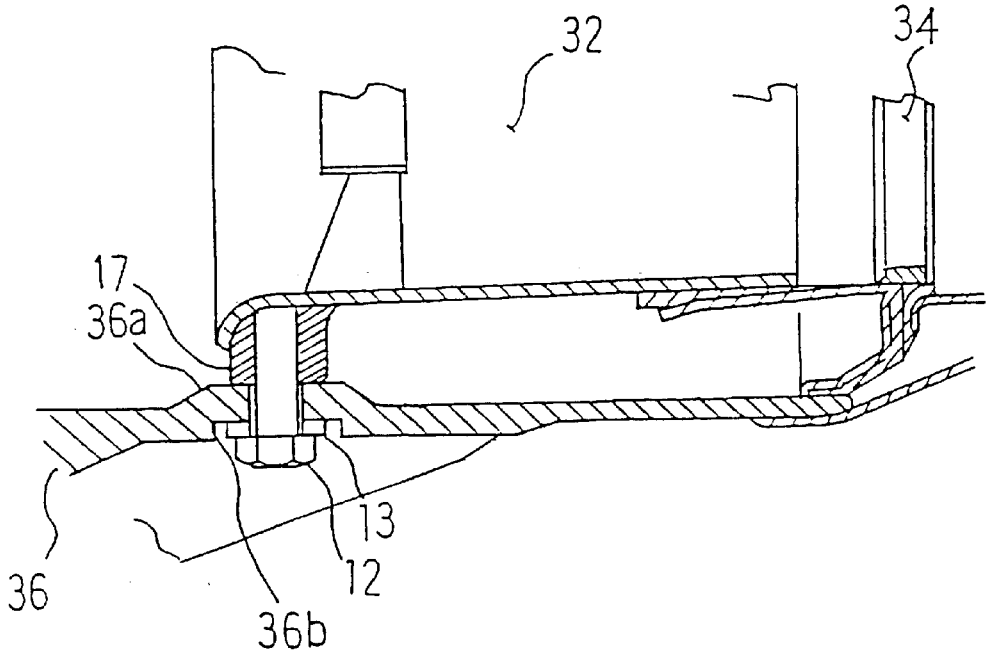
FIG. 12 is an enlarged view of portion D of FIG. 11.

FIG. 12 is an enlarged view of portion D of FIG. 11. The block 17 is fitted to the main swirler 32 by welding. A fitting seat 36a is formed by cladding welding on the inner wall of an end portion 36 of the combustor 20. A recess portion 36*b* for receiving the washer 13 is formed in an outer wall of the combustor 20 at a position corresponding to the fitting seat 36*a*. A bolt hole is bored there, and the bolt 12 is screwed into the block 17 via the washer 13 for fixing of the block 17, whereby the main swirler 32 is fixed to the combustor 20.

Figure 13:
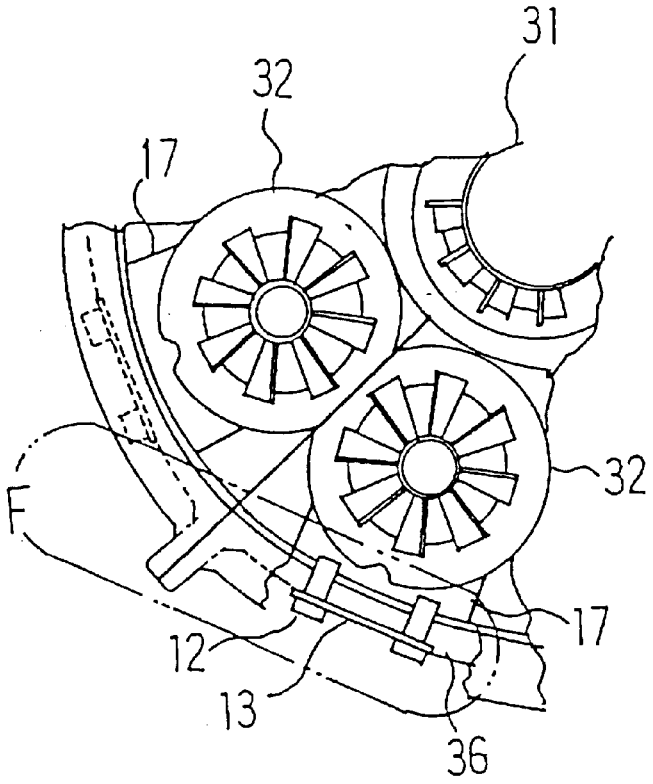
FIG. 13 is partial view seen from plane E—E of FIG. 11.

FIG. 13 is a partial view seen from plane E—E of FIG. 11. The block 17 is fitted by welding to the outer circumferential surface each of the main swirlers 32 arranged in eight pieces and each of the blocks 17 is fixed to the wall of the end portion 36 of the combustor 20 by two bolts 12. The two bolts 17 are screwed into the block 17 via one common washer 13.

Figure 14:
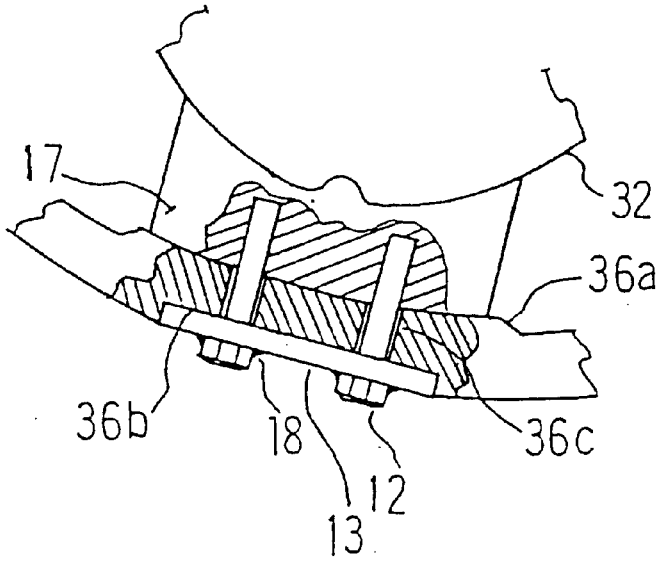
FIG. 14 is a detailed view of portion F of FIG. 13.

FIG. 14 is a detailed view of portion F of FIG. 13, wherein the bolts 12 and the washer 13 are shown enlarged. The recess portion 36*b* is formed not in a curved form, but in a linear form in the outer circumferential surface of the end portion 36 of the combustor 20, and the washer 13 is made as a flat plate of linear shape. The two bolts 12 are inserted into bolt holes 36*c*, which are bored in parallel with each other, to be screwed into the block 17 for fixing thereof and thus for fixing the main swirler 32 to the combustor 20. An anti-rotation welding 18 is applied to the bolt 12 for preventing rotation or loosening thereof. By employing such structure, manufacture of the bolt fitting portion is simplified. As the washer 13 makes contact with the recess portion 36*b* via flat surfaces, a good effect against rotation or loosening of the bolt is obtained. Further, accuracy in the work process and in fitting can be enhanced.

In the prior art gas turbine combustor, as described before, cracks often occur in the welded portion of the fixing metal member 35 supporting the main swirler 32 due to vibration, thermal stress, etc. in operation. The structure itself is a welded structure of thin metal plates, so that there is a problem in the accuracy of fitting and assembling. Further, deformation occurs due to residual strain in the welded portion and the metal plates, which causes mutual contact of the main swirler 32 and the main fuel nozzle arranged therein, increasing abrasion. Also, there is only a narrow working space around the fitting portion of the fixing metal member 35, which requires high skill for performing satisfactory welding.

According to the structure of the present third embodiment, the main swirler 32 is fixed to the combustor 20 by the bolt 12 via the washer 13 and the block 17 fixed to the main swirler 32, whereby accuracy in assembling is enhanced, strain due to welding does not occur and welding work in the narrow space becomes unnecessary. Also, the washer 13 of flat plate shape makes contact with the recess portion 36*b* and the two bolts 12 fix the main swirler 32 to the combustor 20, whereby no loosening of the bolts 12 occurs and precise positioning becomes possible. Further, maintenance and replacement of part, etc. becomes simple, so that all of the above mentioned problems are addressed.

Figure 15:
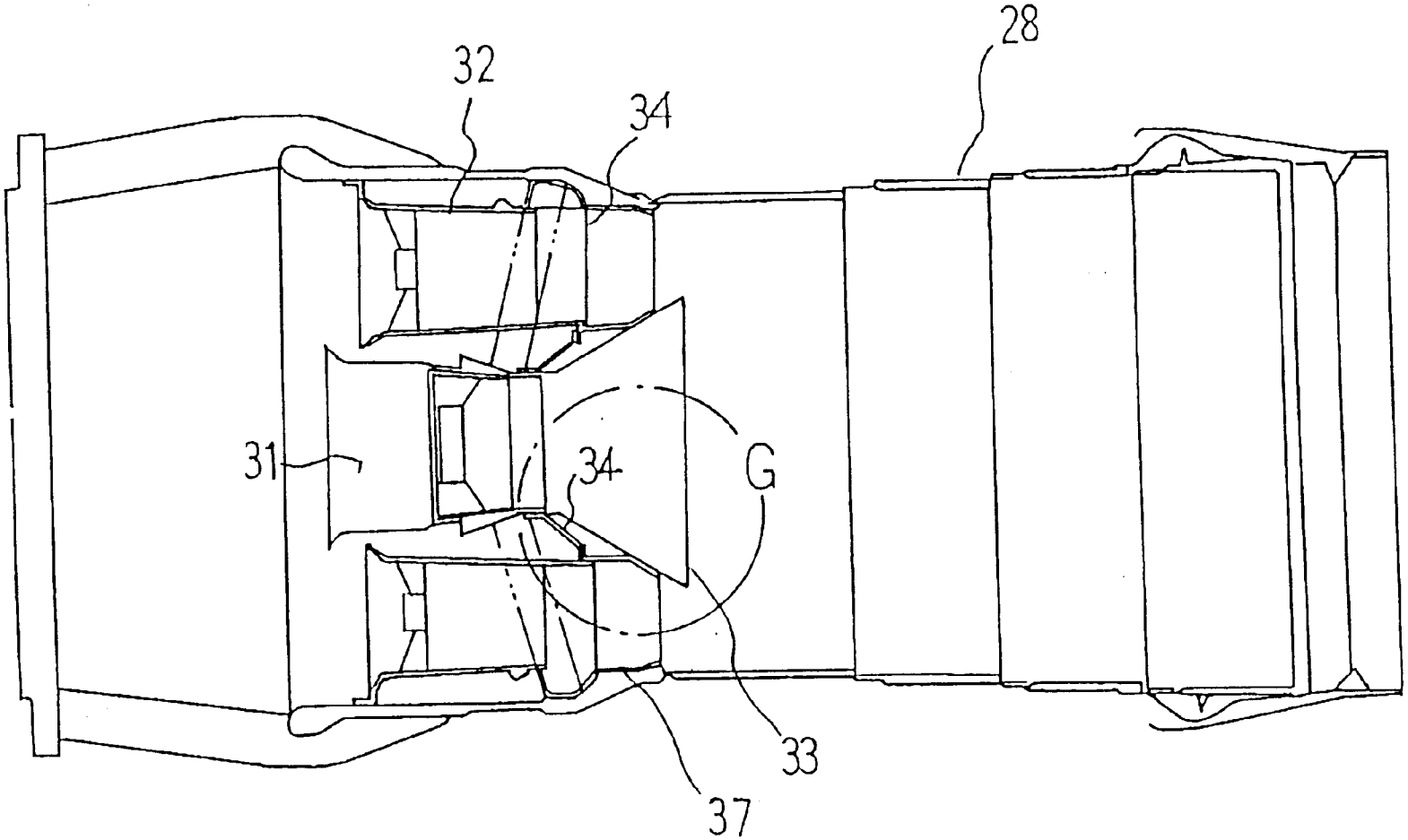
FIG. 15 is a cross sectional side view showing a fitting portion of a pilot cone of a fourth embodiment according to the present invention.
Figure 16:
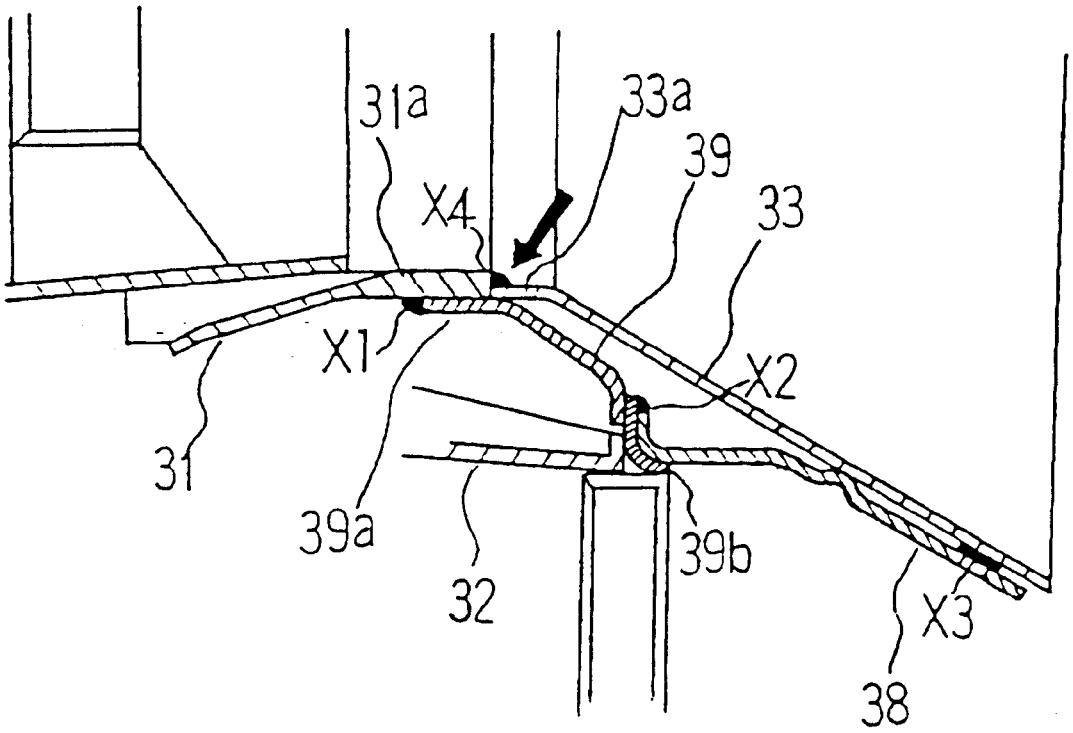
FIG. 16 is a detailed view of portion G of FIG. 15.

Next, a fourth embodiment in the (X-4) portion of the combustor of FIG. 1 will be described with reference to FIGS. 15 to 17. FIG. 15 is a cross sectional side view showing a fitting portion of a pilot cone in the combustor, in contrast with the prior art case shown in FIG. 24. FIG. 16 is a detailed view of portion G of FIG. 15, in contrast with the prior art case shown in FIG. 26.

Figure 24:
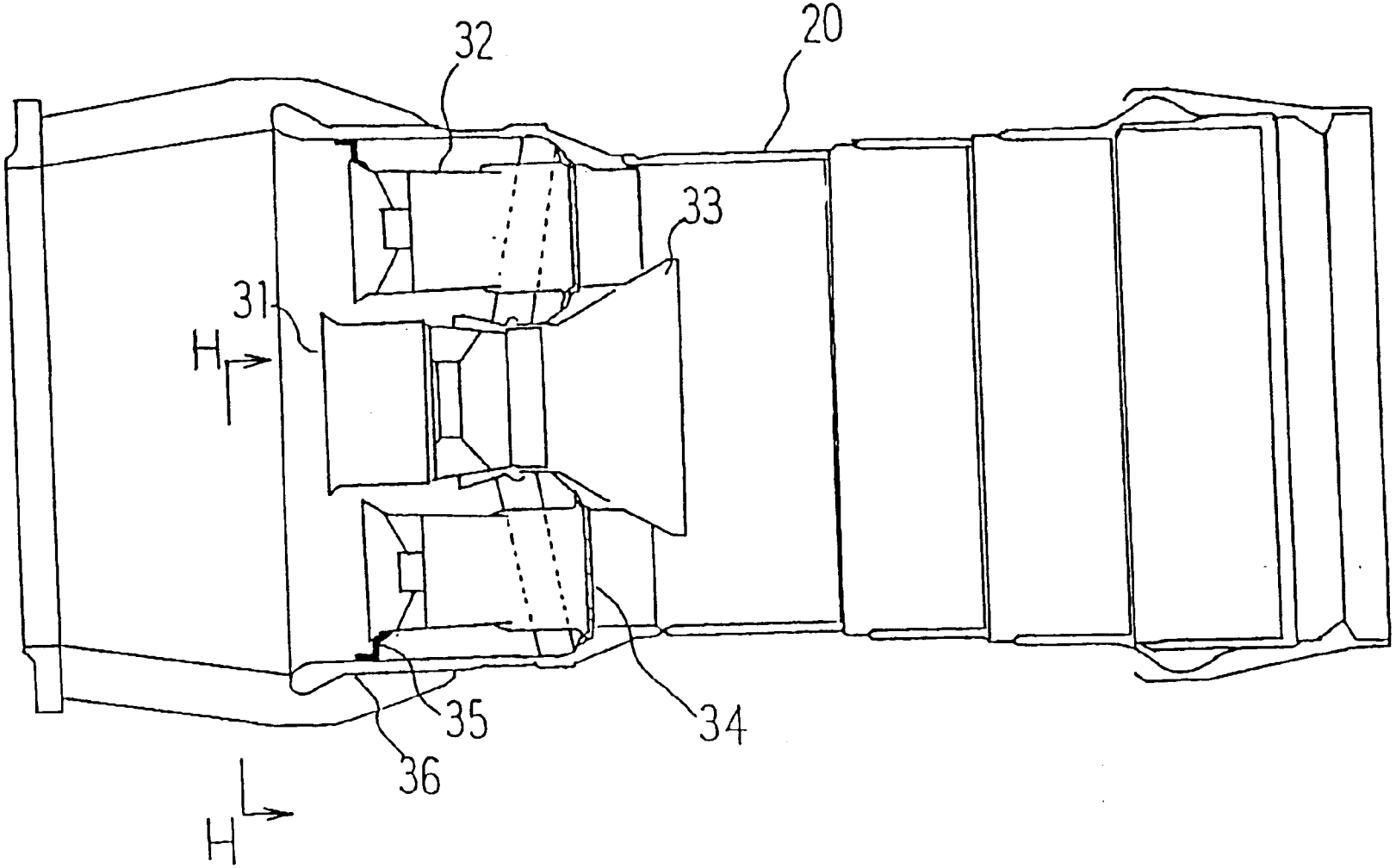
Fig. 24 (Prior Art)
FIG. 24 is a cross sectional side view showing a swirler portion and a pilot cone portion in the prior art combustor.
Figure 25:
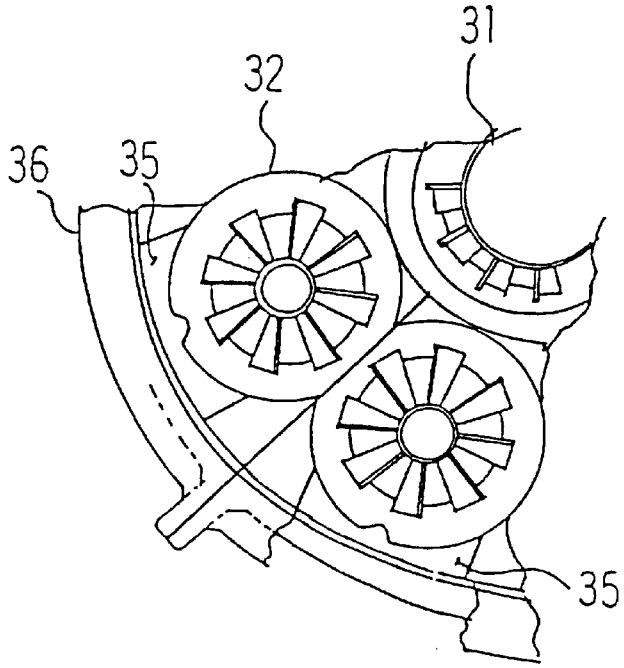
Fig. 25 (Prior Art)
FIG. 25 is a partial view seen from plane H—H of FIG. 24.
Figure 26:
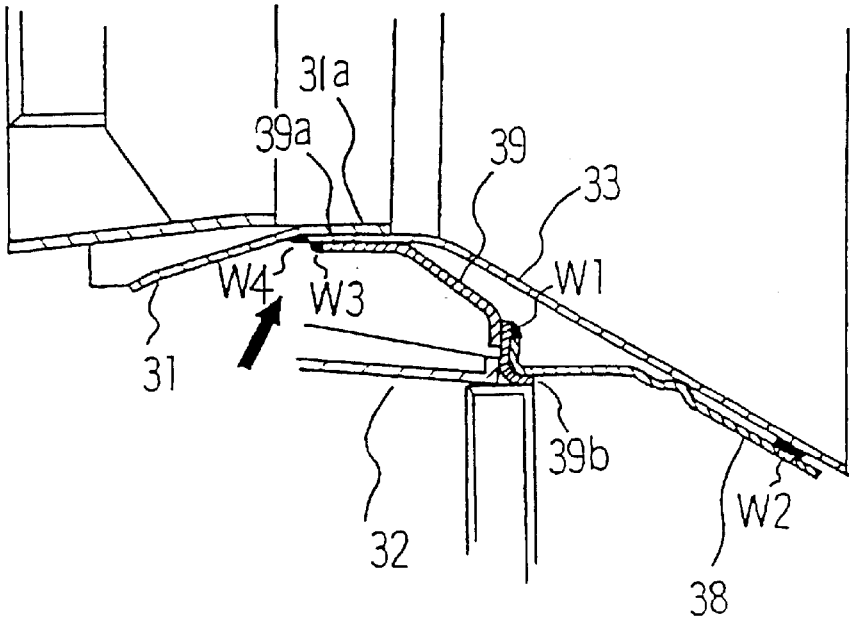
Fig. 26 (Prior Art)
FIG. 26 is a partial detailed cross sectional view of a fitting portion of the pilot cone portion of FIG. 24.

In FIGS. 15 and 16, a pilot swirler 31, a pilot cone 33, a main swirler 32, a base plate 39, a fitting member 39*b* and a cone ring 38 have the same functions as those of the prior art shown in FIGS. 24 and 26. Hence the same reference numerals are used and description thereof is omitted. Featured portions of the present invention are configuration portions shown by numerals 31*a,* 33*a* and welded portions of $X_1$ to $X_4$ will be described in detail below.

In FIG. 16, while a pilot swirler end portion 31*a* is structured in the prior art so as to be inserted into an end portion of the pilot cone 33 in contact with an inner circumferential surface of the pilot cone 33, that of the present invention is structured to be inserted into the cylindrical portion 39*a* of the base plate 39. For this purpose, a pilot cone end portion 33*a* is made shorter as compared with the prior art case. An outer diameter of the pilot cone end portion 33*a* is made approximately the same as that of the pilot swirler end portion 31*a* so that both ends of the pilot cone end portion 33*a* and the pilot swirler end portion 31*a* are welded together in contact with each other.

In the welded structure mentioned above, the pilot swirler 31 is first inserted into the cylindrical portion 39*a* of the base plate 39 to be fixed to an end of the cylindrical portion 39*a* by welding $X_1$ done along the circumferential direction. Then the cone ring 38 is fitted to the fitting member 39*b,* which is integral with the base plate 39, by welding $X_2$ done along the circumferential direction. Then, while the pilot cone end portion 33*a* and the pilot swirler end portion 31*a* make contact with each other, the pilot cone 33 is fitted to the cone ring 38 by welding $X_3$. Thereafter the pilot cone end portion 33*a* and the pilot swirler end portion 31*a* are jointed together by welding $X_4$, which is done from inside of the pilot cone 33 along the circumferential direction. It is to be noted that the welding $X_3$ and $X_4$ may be done in the reverse order, that is, the welding $X_4$ may be earlier and the welding $X_3$ later, and also that a black arrow in FIG. 16 shows a direction in which the welding $X_4$ is done.

According to the welded structure mentioned above, in case of repair work, the welding $X_4$ is removed from inside of the pilot cone 33 and the welding $X_3$ at the pilot cone outlet is also removed, whereby the pilot cone 33 can be easily detached. In the prior art case, there is insufficient work space in the portion of the welding $X_3$, $X_4$ (FIG. 26) and moreover there is difficulty in detaching the pilot cone 33 unless the entire portion of the base plate block is disassembled. In the present fourth embodiment, however, the accuracy of the welded structure is enhanced, whereby the welding strength can be enhanced and workability in repair can be remarkably improved.

Figure 17A:
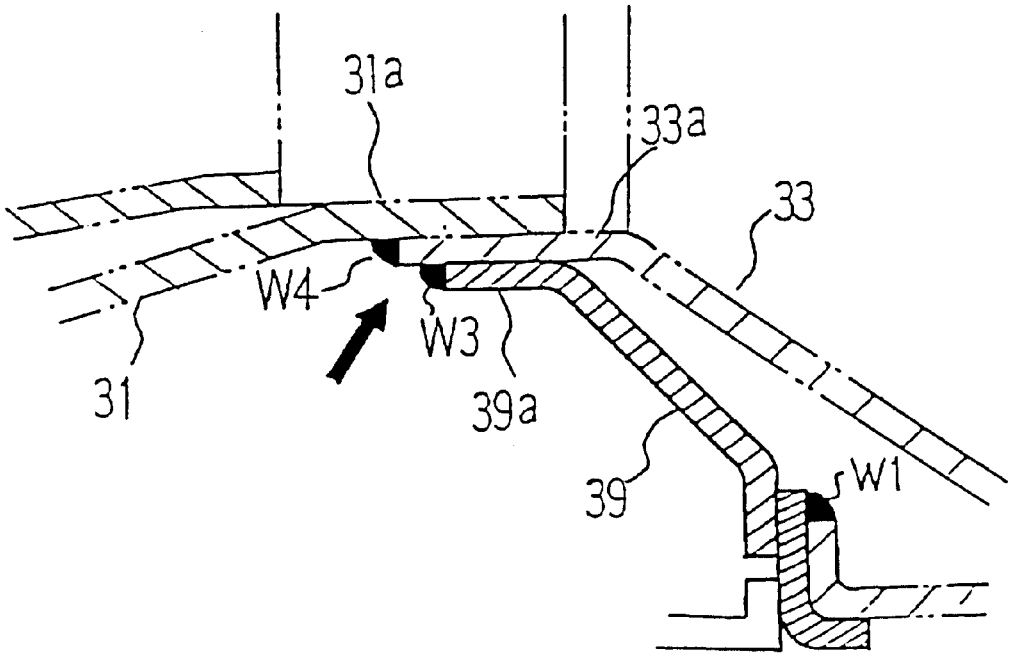
Fig. 17(a) (Prior Art)
FIGS. 17 are enlarged detailed views of welded fitting structures of pilot cones, wherein FIG. 17(*a*) is of a prior art and FIG. 17(*b*) is of the fourth embodiment.
Figure 17B:
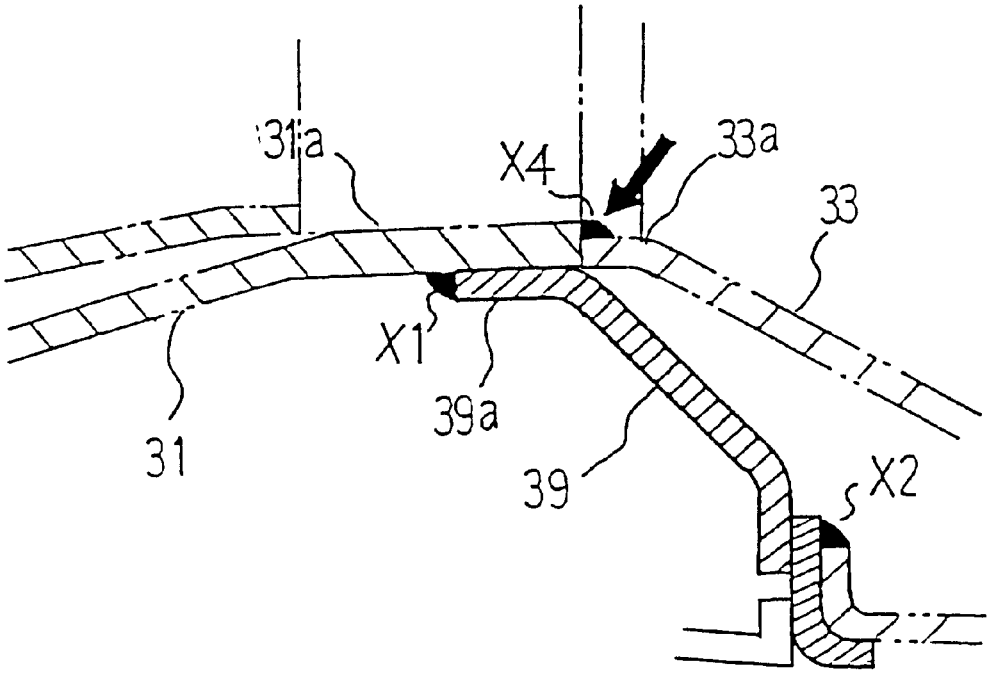

FIGS. 17 are enlarged detailed views of the welded fitting structures of the pilot cones of the prior art and of the present fourth embodiment, wherein FIG. 17(*a*) is of the prior art and FIG. 17(*b*) is of the fourth embodiment. In both of FIGS. 17(*a*) and 17(*b*), while the pilot cone end portion 33*a* is made long enough to be inserted into the cylindrical portion 39*a* of the base plate 39 in the prior art, the portion 33*a* of the present embodiment is made shorter to abut on the pilot swirler end portion 31*a*.

By this structure, the pilot cone 33 of FIG. 17(*b*) is supported by the base plate 39 via the welding $X_4$ of the pilot swirler 31, and it is understood that detachment of the pilot cone 33 is easily done if the welding $X_4$ is removed by work done from inside of the pilot cone 33, as shown by the black arrow of FIG. 17(*b*).

According to the present fourth embodiment as described above, the welded structure is employed such that the pilot swirler 31 is first fitted to the base plate and the pilot cone 33 is fitted thereafter. The welding $X_4$ is done from inside of the pilot cone 33, whereby repair work and detachment of the pilot cone 33 becomes easy, remarkably improving the workability. Thus, a lot of labor and time for repairing can be saved, the accuracy of the welding is enhanced and strain due to the thermal stress can be suppressed to a minimum.

Figure 18:
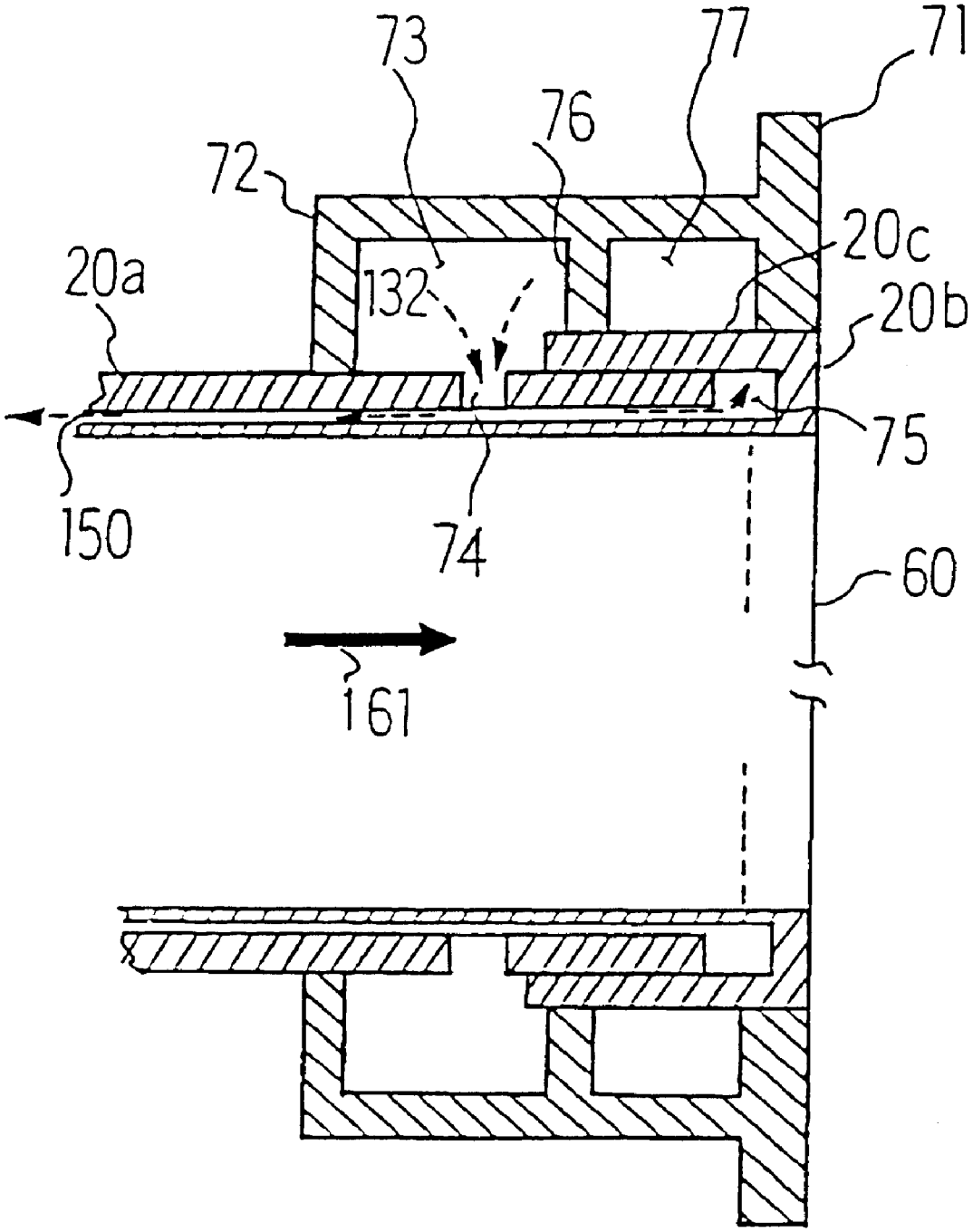
FIG. 18 is a cross sectional view of a steam cooled structure of a combustor tail tube outlet portion of a fifth embodiment according to the present invention.
Figure 29:
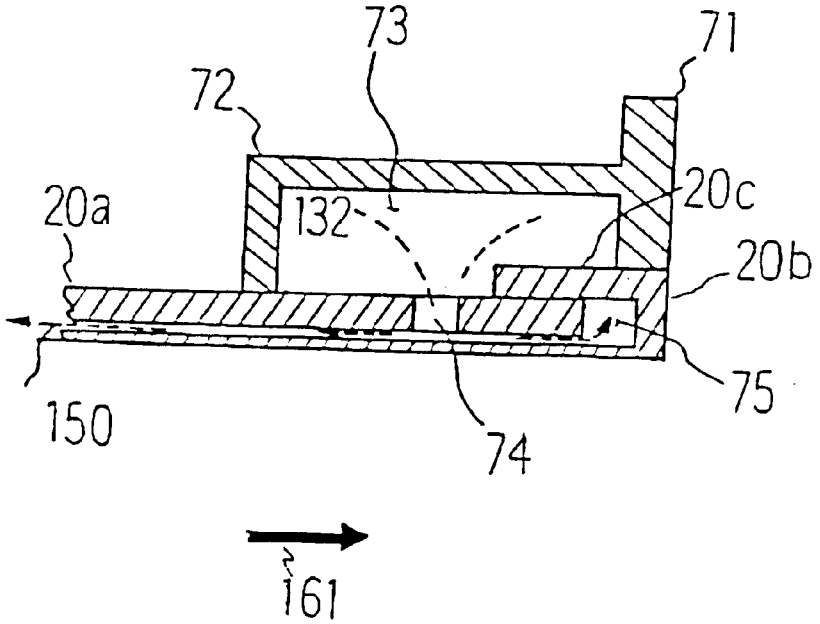
Fig. 29 (Prior Art)
FIG. 29 is a cross sectional view taken on line L—L of FIG. 28.
Figure 30:
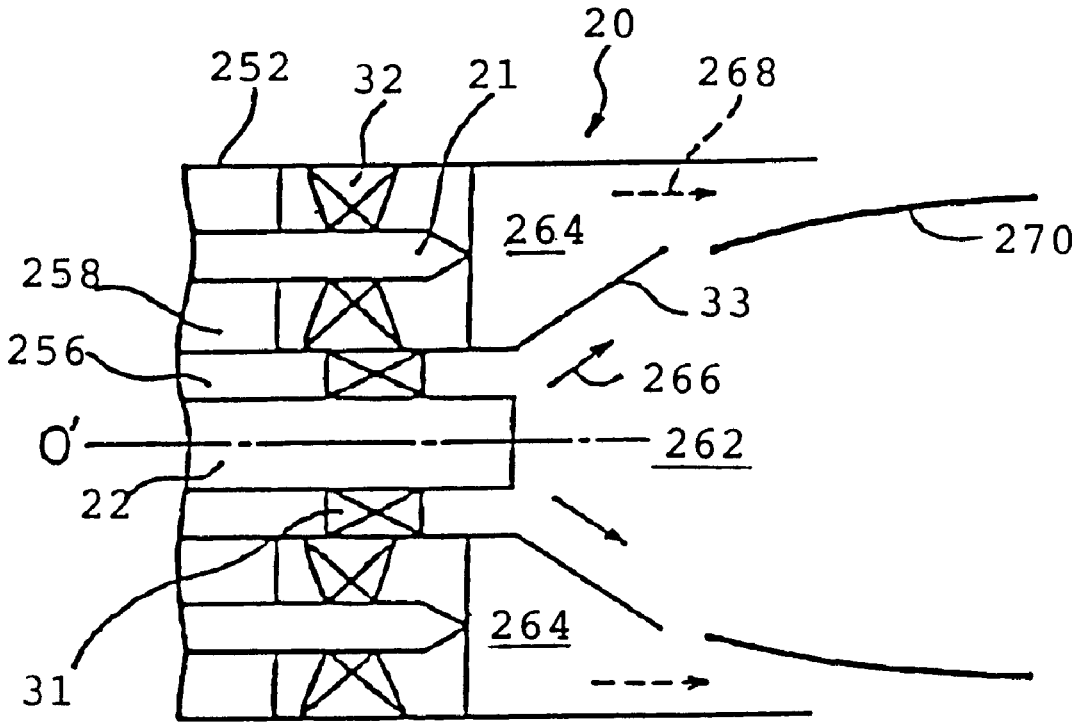
Fig. 30 (Prior Art)
FIG. 30 is a conceptual view of a two stage combustion type gas turbine combustor in the prior art.

Next, a fifth embodiment in the (X-5) portion of the combustor of FIG. 1 will be described with reference to FIG. 18. FIG. 18 is a cross sectional view of a steam cooled structure of a combustor tail tube outlet portion of the fifth embodiment. This steam cooled structure is applicable to the outlet portion of the tail tube 24 shown in FIG. 27, and the structure of FIG. 18 is shown in contrast with that of the prior art shown in FIG. 29.

In FIG. 18, as in the prior art case, a multiplicity of steam passages 150 are provided in a wall 20*a* of the tail tube outlet portion and a cavity 75 is formed in an entire inner circumferential peripheral portion of a flange 71 of the tail tube outlet portion. A manifold 73 and a hollow 77 are formed by being covered circumferentially by a covering member 72 between an outer surface portion of the wall 20*a* of the tail tube outlet portion and the flange 71 and by being partitioned by a rib 76 between them. The manifold 73 communicates with a cooling steam supply pipe (not shown) and the hollow 77 has an air layer formed therein.

In the mentioned cooled structure, cooling steam 132 supplied into the manifold 73 from the cooling steam supply pipe flows into the steam passages 150 through a steam supply hole 74 to cool the wall 20*a,* which is exposed to a high temperature combustion gas of about 1500° C. Also, the steam entering the cavity 75 cools end portions 20*b* and 20*c*. The end portion 20*b* cooled by the steam in the cavity 75 is exposed on a side surface of the flange 71 to air of about 400 to 450° C. in a turbine cylinder. The end portion 20*c* is exposed to the air layer in the hollow 77 and is not directly exposed to the cooling steam 132. While this end portion 20*c* is directly exposed to the cooling steam 132 so as to be excessively cooled in the prior art, such excessive cooling is prevented in the present fifth embodiment.

According to the fifth embodiment as described above, the wall 20*a* of the tail tube outlet portion to be directly exposed to the high temperature combustion gas 161 is sufficiently cooled by the cooling steam 132 supplied into the steam passages 150 from the manifold 73 through the steam supply hole 74. On the other hand, while the steam entering the cavity 75 of the end portion of the tail tube outlet cools the wall exposed to the high temperature combustion gas 161, the end portion 20*c* which is not directly exposed to the high temperature combustion gas 161, is not cooled. This end portion 20*c* makes contact with the air layer in the hollow 77 and is not excessively cooled. Thus, the differential temperature between the inner circumferential wall surface and the outer circumferential structural portion in the tail tube outlet portion is mitigated and the thermal stress is alleviated.

Figure 27:
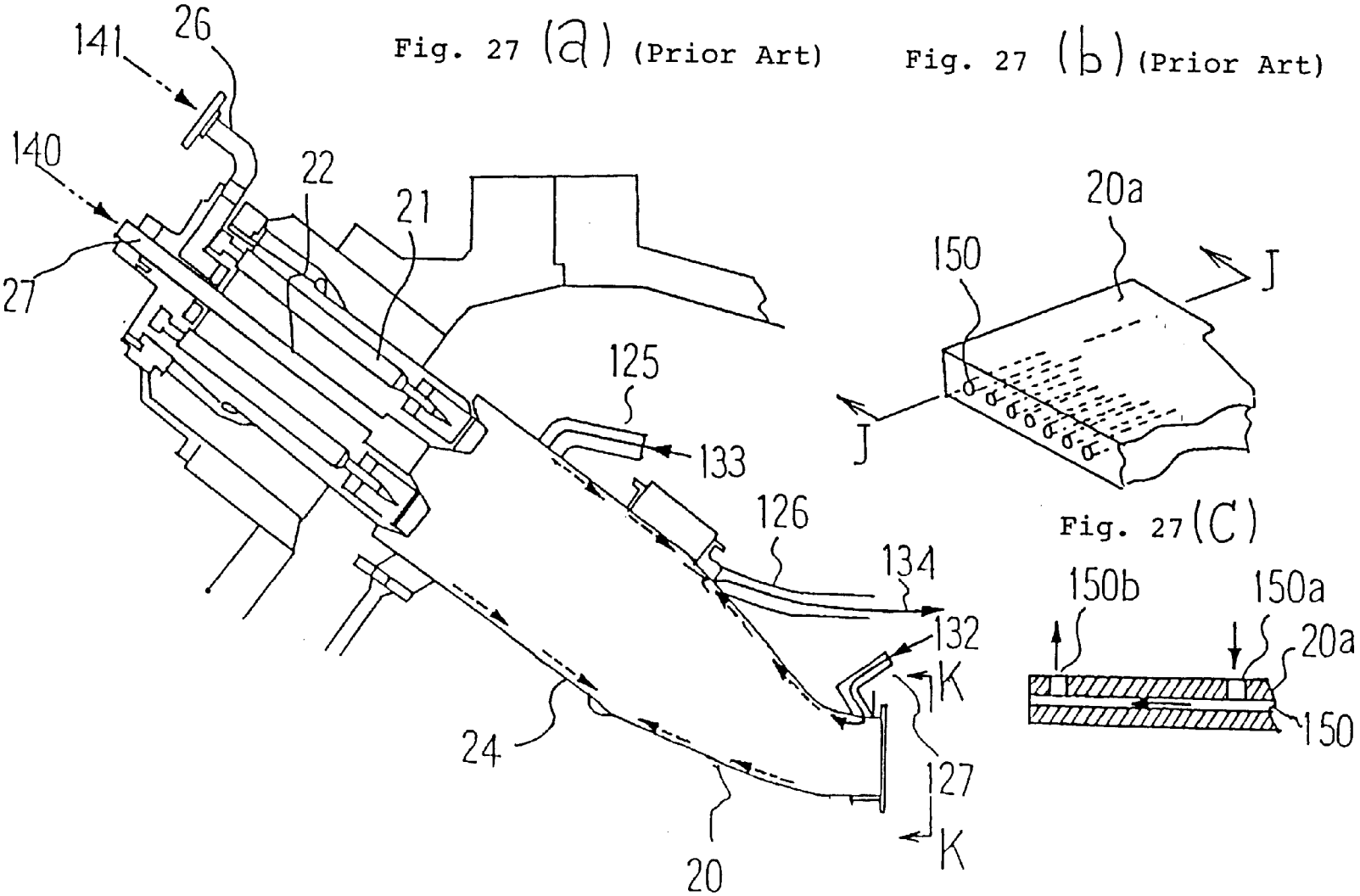
FIGS. 27 are explanatory views showing a tail tube cooling structure in a representative gas turbine combustor in the prior art, wherein FIG. 27(*a*) is an entire view, FIG. 27(*b*) is a perspective view showing a tail tube wall and FIG. 27(*c*) is a cross sectional view taken on line J—J of FIG. 27(*b*).
Figure 28:
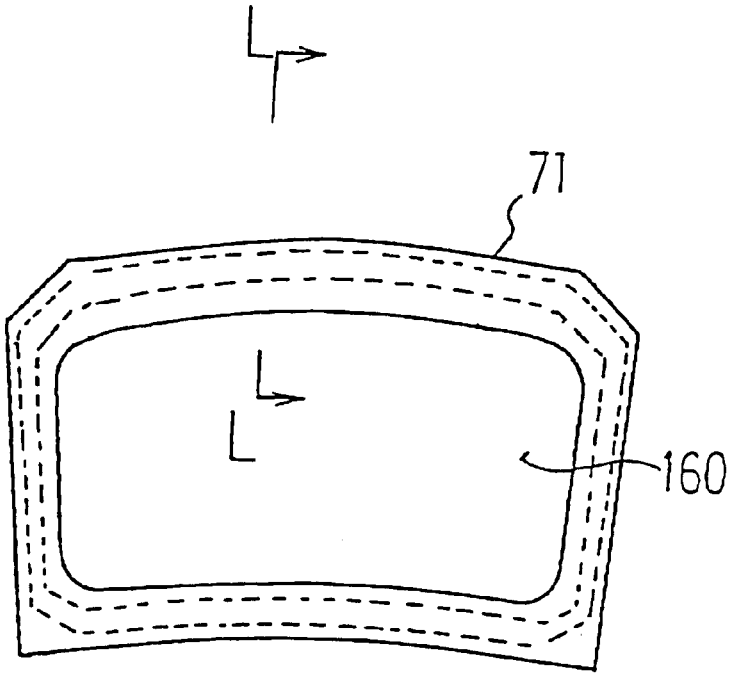
Fig. 28 (Prior Art)
FIG. 28 is a view seen from plane K—K of FIG. 27(*a*).

It is to be noted that although the present fifth embodiment is described with respect to the example shown in FIG. 27, where the steam is supplied from the cooling steam supply pipe 127 of the tail tube outlet portion and from the cooling steam supply pipe 125 on the combustion tube side, and is recovered into the steam recovery pipe 126, supply and recovery of the steam may be done reversely. That is, the steam may be supplied from the pipe 126 and recovered into the pipes 125, 127. In this case the same effect can also be obtained.

Figure 19:
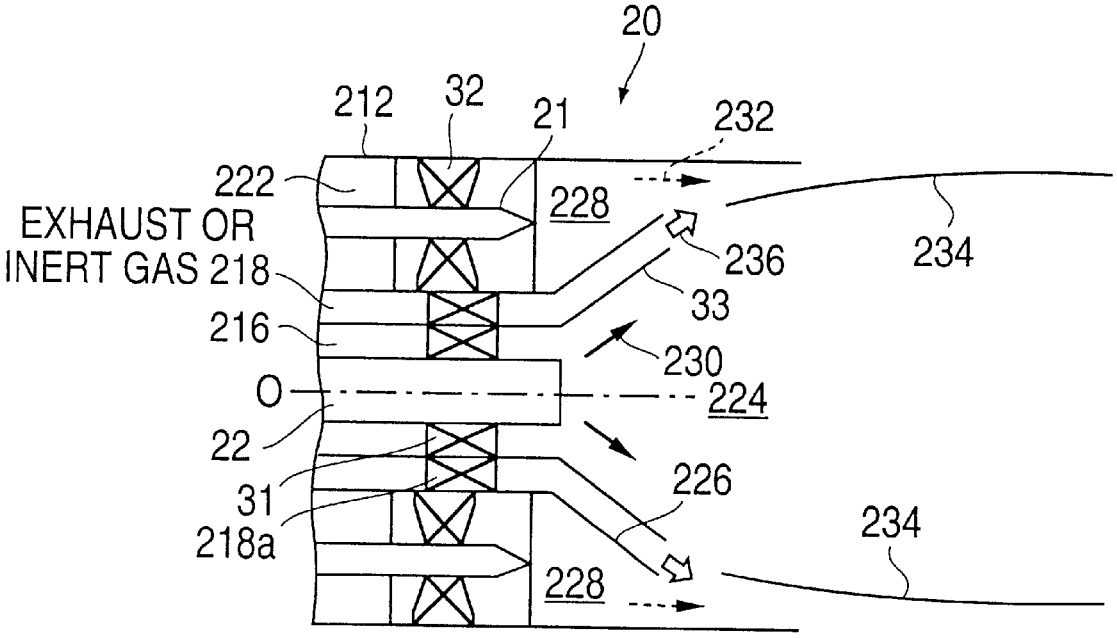
FIG. 19 is a conceptual cross sectional view of a combustor of a sixth embodiment according to the present invention.
Figure 20:
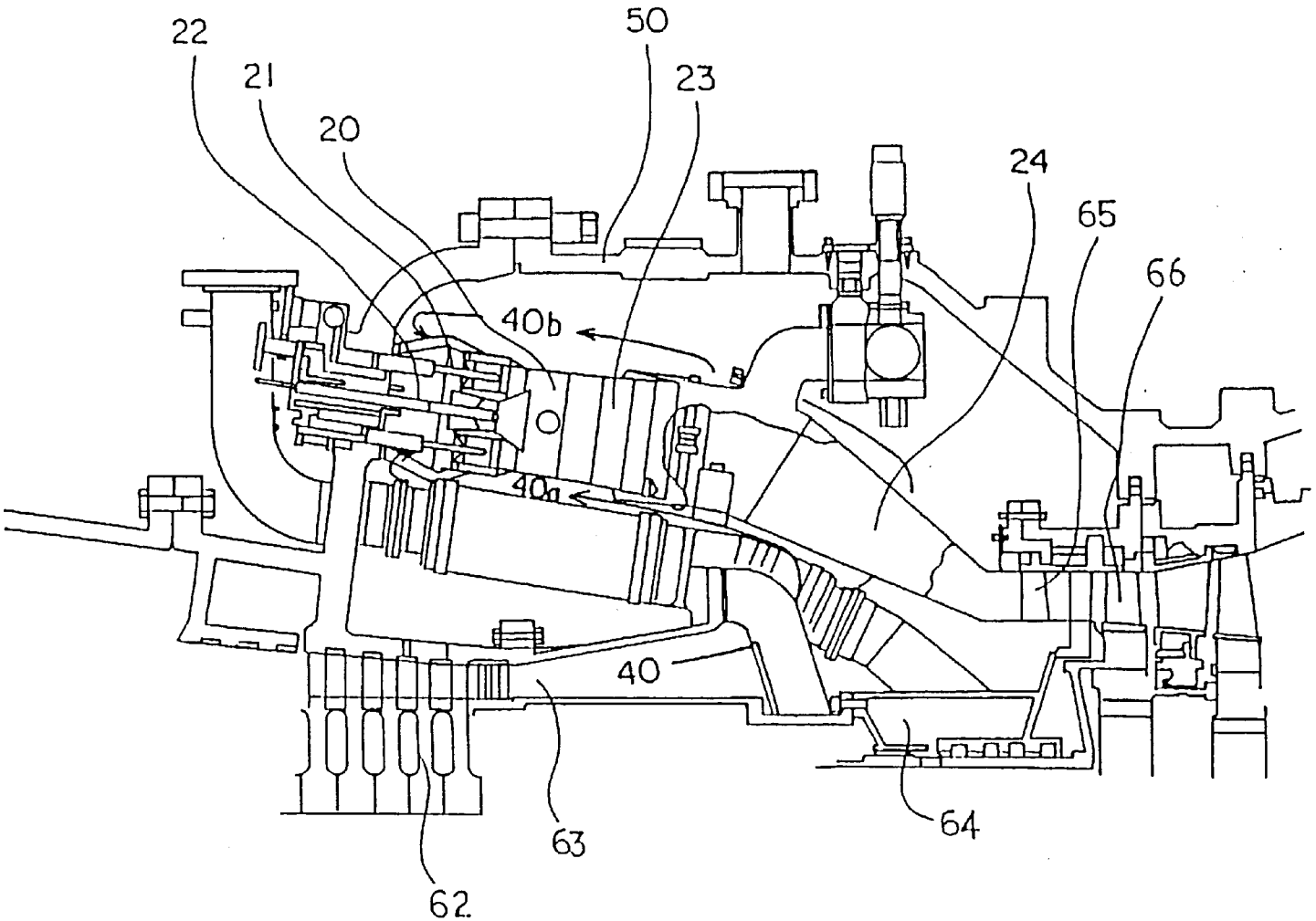
Fig. 20 (Prior Art)
FIG. 20 is a structural arrangement view of a representative gas turbine combustor and surrounding portions thereof in the prior art.

Next, a gas turbine combustor of a sixth embodiment will be described with reference to FIG. 19. In FIG. 19, a combustor 20 is generally formed in a cylindrical shape and a pilot fuel nozzle 22 for supplying pilot fuel is provided in a liner 212 along a central axis O of the combustor 20. A pilot air supply passage 216 is provided around the pilot fuel nozzle 22 and a pilot swirler 31 for holding the pilot flame is provided in the pilot air supply passage 216. Thus, the pilot fuel nozzle 22, the pilot air supply passage 216 and the pilot swirler 31 compose a pilot burner. Downstream of the pilot air supply passage 216 there is provided a pilot cone 33 for forming a pilot combustion chamber 224.

A main fuel nozzle 21 for supplying main fuel and a main air supply passage 222 are provided around the pilot air supply passage 216. A main swirler 32 is provided in the main air supply passage 222. Thus, the main fuel nozzle 21, the main air supply passage 222 and the main swirler 32 compose a main burner. Between the pilot air supply passage 216 and the main air supply passage 222, there is provided an exhaust gas supply passage 218 as a supply passage of shield gas. Downstream of the exhaust gas supply passage 218 and on the outer side of the pilot cone 33, a sub-cone 226 is provided coaxially with the pilot cone 33. Numeral 218*a* designates a swirler provided in the exhaust gas supply passage 218.

The function of the present embodiment will be described below. Pilot air supplied from the pilot air supply passage 216 enters the pilot combustion chamber 224 to flow so as to surround the pilot fuel supplied from the pilot fuel nozzle 22, whereby the pilot fuel together with the pilot air burns to form the pilot flame (a white arrow 230), comprising a diffusion flame. Main fuel supplied from the main fuel nozzle 21 and main air supplied from the main air supply passage 222 are mixed together in a mixing chamber 228 downstream thereof to form a premixture shown by arrow 232. This premixture 232 comes in contact with the pilot flame 230 to form a premixture flame as a main flame 234.

In the present gas turbine combustor 20, exhaust gas produced by the combustion is supplied into a gas turbine (not shown) provided downstream of the combustor 20 for driving the gas turbine. After having driven the gas turbine, the exhaust gas is mostly discharged into the air, but a portion thereof is recirculated into the exhaust gas supply passage 218 of the combustor 20 via a recirculation system including an exhaust gas compressor, etc. (not shown).

The exhaust gas 236 supplied from the exhaust gas supply passage 218 flows through an exhaust gas leading portion as a leading portion of shield gas formed between the pilot cone 33 and the sub-cone 226 to be supplied between the pilot flame 230 and the premixture 232. Thus, mutual contact of the pilot flame 230 and the premixture 232 is suppressed by the exhaust gas 236, whereby the combustion velocity of the main flame 234 is reduced and the main flame 234 becomes longer in the combustor axial direction or in the main flow direction. Hence, the combustion energy concentration released by the main flame 234, or the cross sectional combustion load of the combustor, becomes reduced, exciting forces of combustion vibration are reduced and combustion vibration is suppressed. Further, due to the existence of exhaust gas 236, the oxygen concentration in the main flame 234 is reduced and the flame temperature is reduced, whereby the $NO_x$ quantity produced is reduced.

It is to be noted that although an example using exhaust gas of the gas turbine is described in the present embodiment, the invention is not limited thereto. Exhaust gas from other machinery or equipment may be used, or inert gas, such as nitrogen, supplied from other facilities may be used in place of the exhaust gas. The point is to use gas which is inert with respect to the combustion reaction so as to be able to prevent direct contact of the mixture and the pilot flame and to elongate the premixture flame in the main flow direction in the combustor.

While various embodiments are described with reference to figures, it is understood that the invention is not limited to the particular construction and arrangement of parts and components herein illustrated and described, but embraces such modified forms thereof as come within the scope of the appended claims.

What is claimed is:

1. A gas turbine combustor for a gas turbine, comprising:

an inner tube connected at a downstream side thereof to a tail tube;

a pilot fuel nozzle having a pilot air supply passage there around in a central portion of said inner tube, said pilot air passage having a pilot air swirler therein;

a plurality of main fuel nozzles having main air supply passages therearound and arranged around said pilot fuel nozzle and said pilot air supply passage in said inner tube, said plurality of main air supply passages having respective main swirlers therein, to form a main combustion premixture from main fuel from said main fuel nozzles and main air from said main swirlers being mixed together, and a combustion-inert shield gas supply to supply shield gas between the pilot air from said pilot air swirler and the main combustion premixture.

2. The gas turbine combustor of claim 1, wherein said shield gas supply comprises a supply of recirculated exhaust gas produced by combustion in said gas turbine combustor.

3. The gas turbine combustor of claim 1, wherein said shield gas supply comprises a shield gas supply passage in said inner tube around said pilot air supply passage.

4. The gas turbine combustor of claim 3, and further comprising a swirler in said shield gas supply passage.

5. The gas turbine combustor of claim 3, wherein a pilot cone extends downstream from said pilot air passage to form a pilot combustion chamber, and a sub-cone extends downstream from said shield gas supply passage coaxially with and outside of said pilot cone to form a gas leading portion such that shield gas flows from said shield gas supply passage to said gas leading portion between said pilot cone and said sub-cone.

6. A gas turbine combustor for a gas turbine, comprising:

an inner tube connected at a downstream side thereof to a tail tube;

a pilot fuel nozzle having a pilot air supply passage there around in a central portion of said inner tube, said pilot air passage having a pilot air swirler therein, to form a pilot flame from fuel from said pilot nozzle and pilot air;

a plurality of main fuel nozzles having main air supply passages therearound and arranged around said pilot fuel nozzle and said pilot air supply passage in said inner tube, said plurality of main air supply passages having respective main swirlers therein, to form a main combustion premixture from main fuel from said main fuel nozzles and main air from said main swirlers being mixed together; and means for supplying a combustion-inert shield gas between the pilot flame and the main combustion premixture in order to suppress mutual contact of the pilot flame and the premixture.

7. The gas turbine combustor of claim 6, wherein said means comprises a supply of recirculated exhaust gas produced by combustion in said gas turbine combustor.

8. The gas turbine combustor of claim 6, wherein said means comprises a shield gas supply passage in said inner tube around said pilot air supply passage.

9. The gas turbine combustor of claim 8, and further comprising a swirler in said shield gas supply passage.

10. The gas turbine combustor of claim 8, wherein a pilot cone extends downstream from said pilot air passage to form a pilot combustion chamber, and a sub-cone extends downstream from said shield gas supply passage coaxially with and outside of said pilot cone to form a gas leading portion such that shield gas flows from said shield gas supply passage to said gas leading portion between said pilot cone and said sub-cone.

* * * * *